US010316516B2

(12) United States Patent
Carlyon

(10) Patent No.: US 10,316,516 B2
(45) Date of Patent: Jun. 11, 2019

(54) INSULATED PANEL ASSEMBLY

(71) Applicant: MITEK HOLDINGS, INC., Wilmington, DE (US)

(72) Inventor: Zeke Carlyon, Vassar, MI (US)

(73) Assignee: MITEK HOLDINGS, INC., Wilmington, DE (US)

( * ) Notice: Subject to any disclaimer, the term of this patent is extended or adjusted under 35 U.S.C. 154(b) by 0 days.

(21) Appl. No.: 15/413,031

(22) Filed: Jan. 23, 2017

(65) Prior Publication Data

US 2018/0209137 A1 Jul. 26, 2018

(51) Int. Cl.

| | |
|---|---|
| ***E04C 2/292*** | (2006.01) |
| ***F25D 23/06*** | (2006.01) |
| ***E04C 2/38*** | (2006.01) |
| *E04B 1/80* | (2006.01) |
| *E04B 1/14* | (2006.01) |

(52) U.S. Cl.

CPC ..... *E04C 2/292* (2013.01); *E04C 2/384* (2013.01); *F25D 23/063* (2013.01); *E04B 1/14* (2013.01); *E04B 1/80* (2013.01)

(58) Field of Classification Search

CPC . E04B 1/14; E04B 1/6158; E04B 1/08; E04B 2002/0252; E04B 2002/867; E04B 2/02; E04B 2/08; E04B 2/60; E04B 2/7401; B26D 1/553; B26D 3/12; B32B 15/046; B32B 15/043; B32B 2266/0278; B32B 2307/304; B32B 3/06; E04C 2/292; E04C 2/384

USPC ..... 52/309.9, 309.7, 309.16, 586.1, 586.2

See application file for complete search history.

(56) References Cited

U.S. PATENT DOCUMENTS

| | | | | |
|---|---|---|---|---|
| 1,637,871 | A | 8/1927 | Nosan | |
| 1,984,007 | A | 12/1934 | Babbitt | |
| 2,039,601 | A | 5/1936 | London | |
| 2,293,399 | A | 8/1942 | Moecker, Jr. et al. | |
| 2,304,718 | A | 12/1942 | Swart | |
| 2,327,585 | A | 8/1943 | Ulrich | |
| 2,553,363 | A | 5/1951 | Droeger | |
| 2,703,559 | A | 3/1955 | Godshalk | |
| 3,037,590 | A | 6/1962 | Pavlecka | |
| 3,153,817 | A * | 10/1964 | Pease, Jr. | E06B 3/825 52/309.9 |
| 3,176,807 | A | 4/1965 | Pavlecka | |
| 3,289,372 | A | 12/1966 | Adams et al. | |
| 3,310,926 | A | 3/1967 | Brandreth et al. | |
| 3,640,039 | A * | 2/1972 | McKee | F16B 5/0052 52/281 |
| 3,662,509 | A | 5/1972 | Studzinski | |
| 3,670,466 | A | 6/1972 | Lynch | |
| 3,729,889 | A * | 5/1973 | Baruzzini | E04B 1/6162 52/264 |

(Continued)

*Primary Examiner* — Robert Canfield
*Assistant Examiner* — Matthew J Gitlin
(74) *Attorney, Agent, or Firm* — Stinson Leonard Street LLP

(57) ABSTRACT

Insulated panel assemblies can be used to construct an insulating enclosure and the like. The insulated panel assemblies can have the same configuration and fit together to form a substantially sealed, insulated enclosure. The insulated panel assemblies themselves are particularly constructed for ease of formation and construction of the panel assemblies. Methods of forming an insulated panel assembly and using the panel assemblies to construct an insulated disclosure are also disclosed.

20 Claims, 23 Drawing Sheets

(56) References Cited

U.S. PATENT DOCUMENTS 3,786,609 A * 1/1974 Difazio ..... E06B 3/825 52/309.5
3,837,134 A * 9/1974 DiFazio ..... E06B 3/825 52/784.13
4,014,150 A 3/1977 Wells et al.
4,170,952 A 10/1979 McCown
4,190,305 A 2/1980 Knight et al.
4,223,505 A 9/1980 Krebel et al.
4,251,972 A 2/1981 Interlante
4,263,763 A 4/1981 Bouwens
4,274,239 A 6/1981 Carroll
4,311,460 A 1/1982 Lauersdorf et al.
4,346,543 A 8/1982 Wilson et al.
4,373,312 A 2/1983 Kim
4,434,592 A 3/1984 Reneault et al.
4,486,994 A * 12/1984 Fisher ..... E04B 1/14 264/46.5
4,651,489 A 3/1987 Hodges et al.
4,686,803 A 8/1987 Couderc et al.
4,744,186 A 5/1988 Smith et al.
4,764,108 A 8/1988 Carthew et al.
5,036,638 A 8/1991 Kurtz, Jr.
5,056,290 A * 10/1991 Alexander ..... E04B 1/6116 52/309.11
5,216,810 A * 6/1993 Kendall ..... E06B 3/2675 29/897.312
5,379,561 A 1/1995 Saito
5,561,959 A 10/1996 Alderman et al.
5,687,956 A * 11/1997 Vesper ..... E04H 17/168 256/24
5,694,730 A * 12/1997 Del Rincon ..... E04B 1/6154 403/298
5,724,784 A 3/1998 Menchetti
5,758,464 A 6/1998 Hatton
5,934,033 A 8/1999 Matsuyama et al.
6,074,206 A 6/2000 Lauersdorf
6,158,190 A 12/2000 Seng
6,167,624 B1 * 1/2001 Lanahan ..... B26D 1/553 264/142
6,289,646 B1 9/2001 Watanabe
6,345,511 B1 2/2002 Esty et al.
6,374,571 B1 4/2002 Mann
6,494,012 B2 12/2002 Seng
6,530,191 B2 3/2003 Rieke et al.
6,546,690 B1 4/2003 Lamberts
6,584,742 B1 * 7/2003 Kligler ..... E04B 2/58 52/241
6,694,694 B2 2/2004 Zeeff
6,694,702 B2 * 2/2004 Weymer ..... B23K 26/26 52/309.15
6,868,648 B2 3/2005 Glover et al.
6,923,493 B2 8/2005 Buchholz et al.
6,974,383 B2 12/2005 Lewis et al.
7,107,731 B2 * 9/2006 Record ..... E04C 2/292 52/284
7,849,651 B2 12/2010 Fujito et al.
8,061,929 B2 * 11/2011 Dagesse ..... E01C 9/086 404/34
8,151,539 B2 * 4/2012 Grinsted ..... E04C 2/205 52/220.2
8,186,119 B1 * 5/2012 Huff ..... F24F 3/0442 52/302.3
8,286,399 B2 * 10/2012 Brown ..... E04B 1/14 52/404.4
8,513,572 B2 8/2013 Schumacher et al.
8,658,274 B2 * 2/2014 Chen ..... B29C 47/0019 428/148
8,844,243 B1 * 9/2014 Gillman ..... E04C 2/38 52/309.9
9,027,301 B2 * 5/2015 Guinn ..... E04B 1/4178 52/309.9
9,309,671 B2 * 4/2016 Van Sloun ..... E04C 2/296
9,677,711 B2 6/2017 Boyeau et al.
2001/0052205 A1 12/2001 Herren
2002/0023401 A1 * 2/2002 Budge ..... E04B 2/60 52/426
2003/0009969 A1 * 1/2003 Herbeck ..... E04C 2/292 52/474
2004/0055248 A1 3/2004 Grillos
2005/0055935 A1 3/2005 Layfield
2006/0026925 A1 2/2006 Layfield
2006/0174577 A1 * 8/2006 O'Neil ..... E04B 1/6145 52/586.2
2007/0245640 A1 * 10/2007 Bergqvist ..... E02D 5/56 52/92.2
2007/0261345 A1 11/2007 Janka et al.
2009/0100780 A1 * 4/2009 Mathis ..... E04B 1/14 52/578
2009/0205277 A1 * 8/2009 Gibson ..... E04B 7/22 52/309.9
2010/0011699 A1 * 1/2010 Weimer ..... E04B 2/7401 52/745.1
2010/0126111 A1 * 5/2010 Leonard ..... E04B 1/14 52/745.19
2012/0240512 A1 * 9/2012 Ting ..... E04B 1/14 52/745.13
2016/0130820 A1 * 5/2016 Cullen ..... E04F 13/0807 52/483.1
2016/0215997 A1 * 7/2016 Carlyon ..... B32B 5/20

* cited by examiner

INSULATED PANEL ASSEMBLY

FIELD OF THE INVENTION

The present invention generally relates to insulated enclosures, and more specifically to a thermally insulating panel assembly for forming an insulated enclosure.

BACKGROUND

Thermally insulated enclosures are useful in many contexts. For example, the use of thermally insulated enclosures for HVAC equipment (e.g., heat exchangers, compressors, blowers, filters, fans, motors, cooling elements, heating elements, humidifying elements) is commonplace. Other types of thermally insulated enclosures such as walk in coolers and freezers often need to be constructed rapidly and with an ability to be readily knocked down. Thermally insulated enclosures are often constructed with panels filled with insulation to minimize the transmission of thermal energy from the interior to the exterior of the enclosure. Typically, the panels include inner and outer (first and second) panel members of metal that are joined together to form a volume that receives the insulation. The panel members can be connected together using plastic fasteners and/or gaskets to reduce thermal transmission. However, the inner and outer panel members are often difficult to manufacture, and it can be difficult and time-consuming to attach the panel members to each other to form the insulated enclosure.

SUMMARY

In one aspect, an insulated panel assembly for use in forming a thermally insulated enclosure generally comprises a housing having inner and outer major surfaces and edge surfaces extending between the inner and outer major surfaces. An interior cavity is defined by the housing, and an insulating core is located within the interior cavity of the housing. An elongate slot in at least one of the edge surfaces of the housing extends inward of the edge surface toward the interior cavity.

In a still further aspect, a method of assembling an insulated panel assembly for use in forming a thermally insulated enclosure includes the step of locating a first panel member relative to a second panel member such that the first panel member opposes the second panel member and is spaced apart from the first panel member. Insulation is positioned between the first and second panel members. The located first panel member and second panel member define a housing having inner and outer major surfaces and edge surfaces extending between the inner and outer major surfaces and an interior cavity in which the insulation is positioned. A slot is provided in the housing extending inward from at least one of the edge surfaces of the housing toward the interior cavity.

In yet another aspect of the present invention, a method of assembling a thermally insulated enclosure generally comprises providing a first thermally insulated panel assembly having inner and outer major surfaces and edge surfaces extending between the inner and outer major surfaces and an interior cavity in which insulation is disposed. A slat is inserted into a slot in one of the edge surfaces of the housing. A second thermally insulated panel assembly is provided having inner and outer major surfaces and edge surfaces extending between the inner and outer major surfaces and an interior cavity in which insulation is disposed next to the first panel assembly. The slat is received in a slot in one of the edge surfaces of the housing of the second thermally insulated panel assembly thereby connecting the first and second panel assemblies together.

Other objects and features of the present invention will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
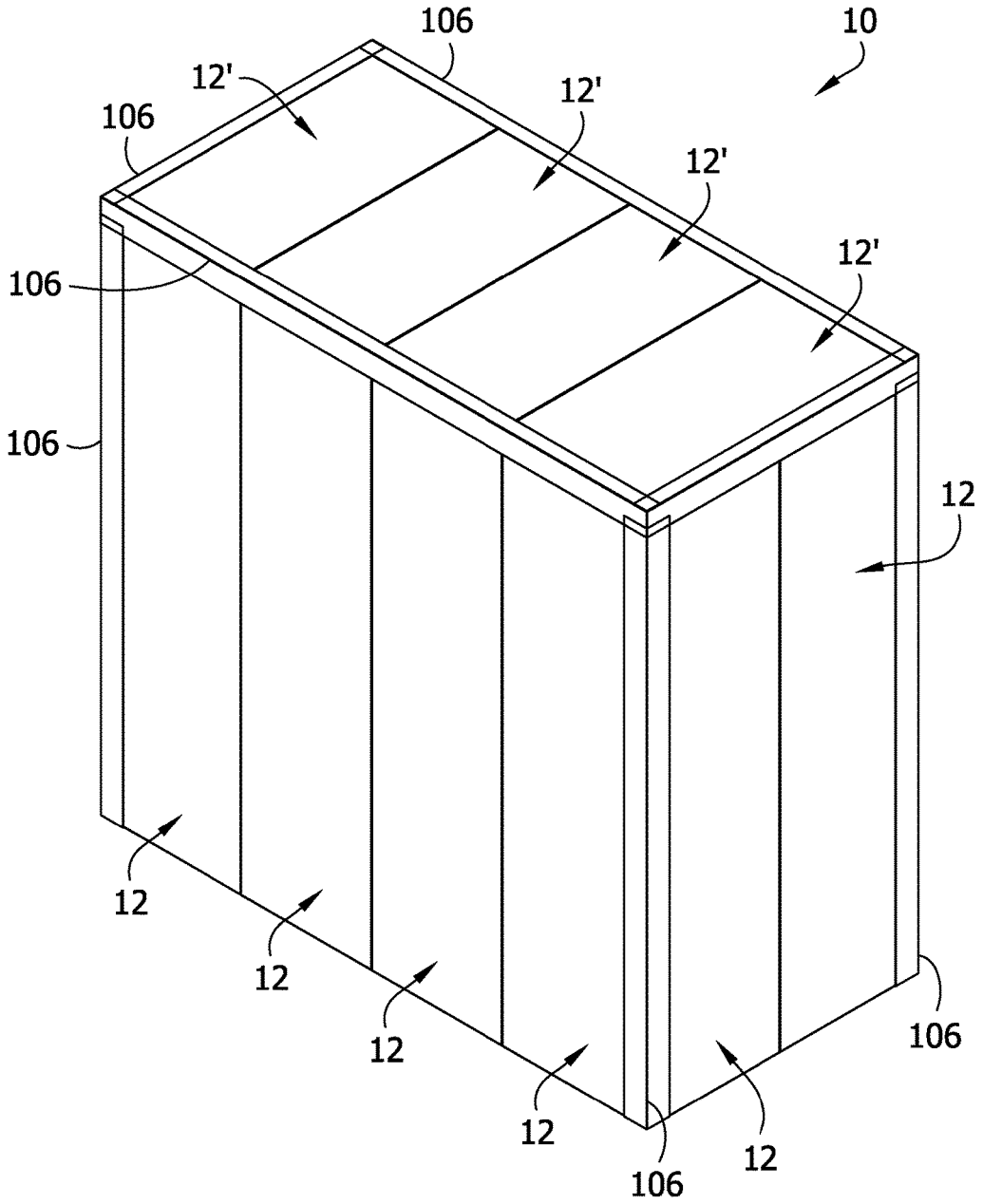
FIG. 1 is a perspective of a thermally insulated enclosure formed from insulated panel assemblies.
Figure 2:
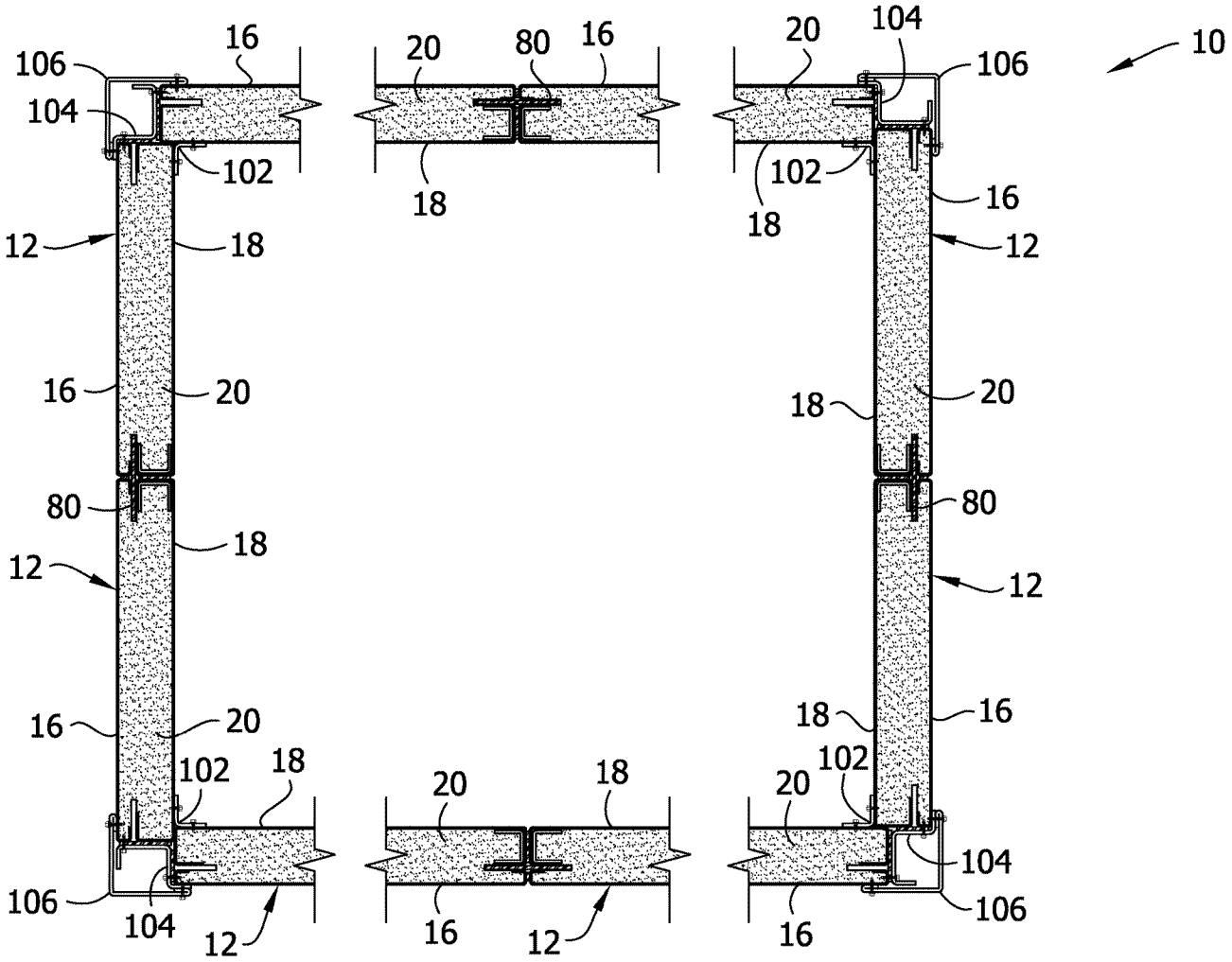
FIG. 2 is an enlarged, horizontal section of the enclosure, partially broken away, illustrating the connection between panel assemblies of the thermally insulated enclosure.
Figure 2A:
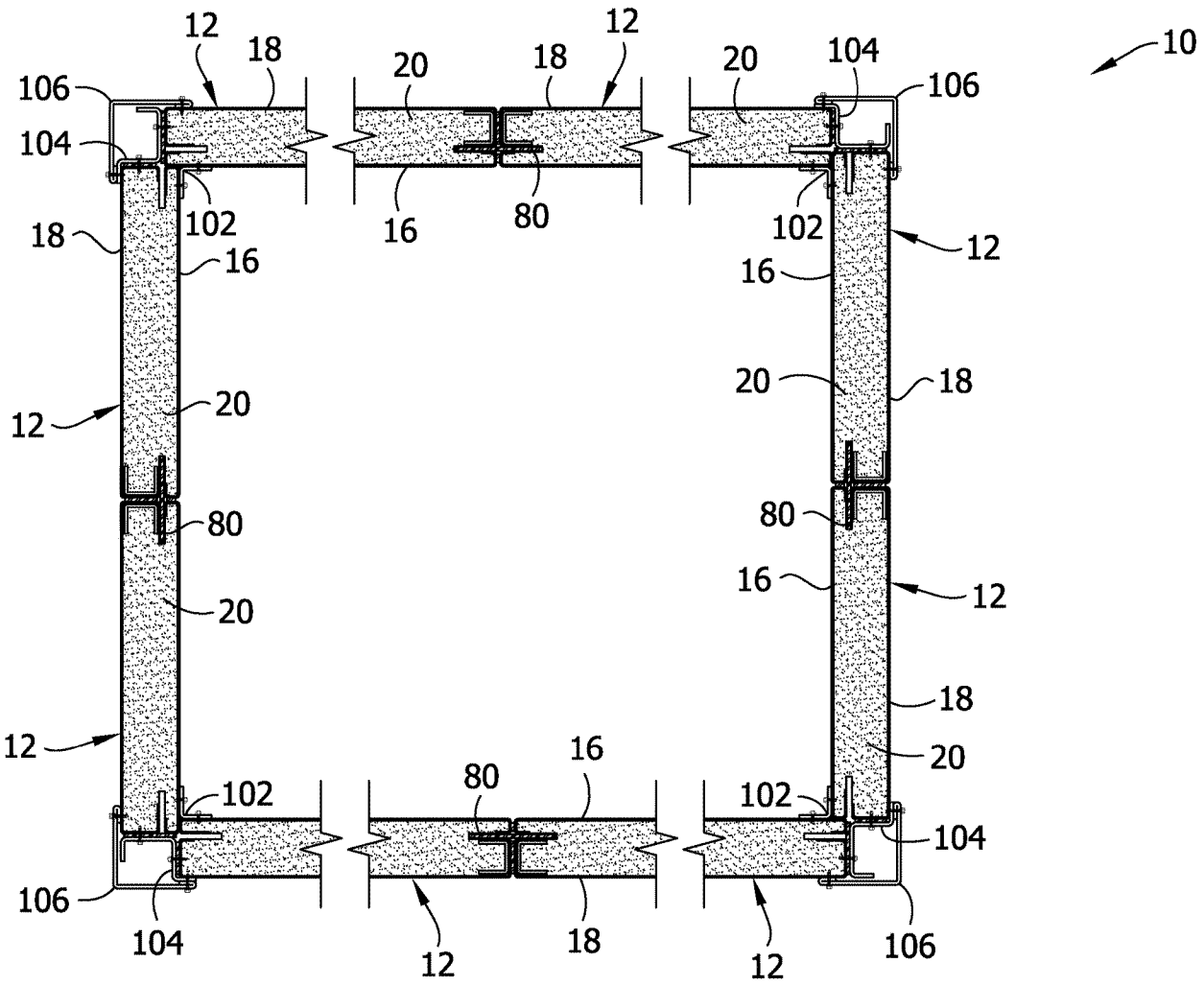
FIG. 2A is a horizontal section of a thermally insulated enclosure, partially broken away, showing the connection between panel assemblies of the thermally insulated enclosure having an alternative panel assembly arrangement.

Referring to FIGS. 1-2A, a thermally insulated enclosure, shown generally at 10, comprises a number of insulated panel assemblies 12, 12'. The panel assemblies comprise side wall panel assemblies 12 and roof panel assemblies 12' each having generally the same construction. It is noted however that, as illustrated in FIG. 1, the side wall panel assemblies 12 may have a different length than the roof panel assemblies 12'. The insulated panel assemblies are attached to each other, as described below, and may also be attached to a base 13 including a framing channel 14 and floor 15 (FIGS. 5 and 5A) to form the thermally insulated enclosure 10. As explained more fully hereinafter, the insulated panel assemblies 12, 12' are configured to permit easy and rapid construction of thermally insulated enclosures such as the enclosure 10. These thermally insulated enclosures can serve as housing for equipment or form structures such as a walk in cooler or freezer. In all applications, the enclosures prevent ready heat transfer to or from an interior of the enclosure.

Figure 8:
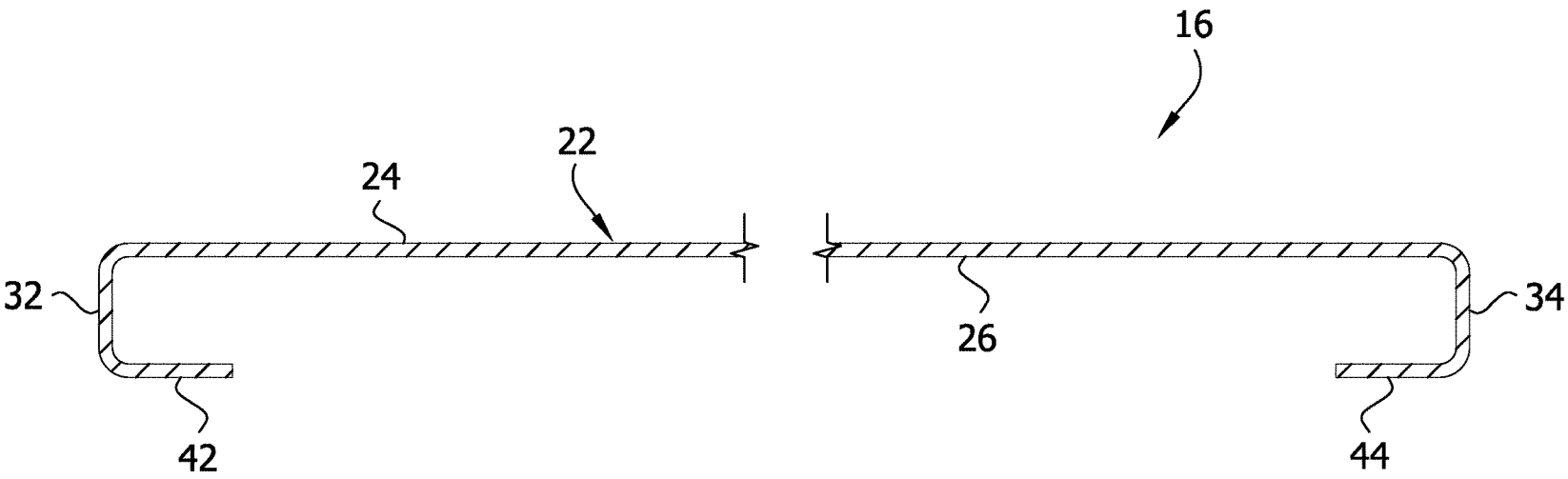
FIG. 8 is an enlarged, horizontal section of a first panel member of the panel assembly of FIG. 7 with portions broken away.
Figure 9:
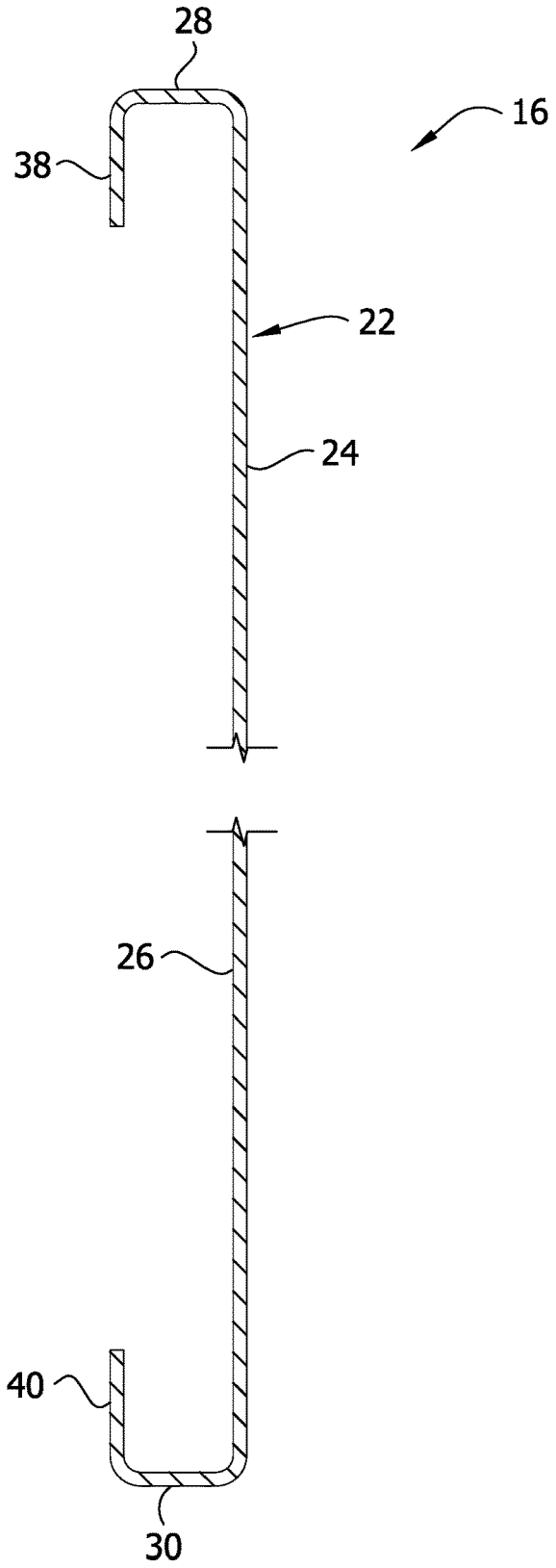
FIG. 9 is a vertical section of the first panel member of FIG. 8 with portions broken away.

Referring to FIGS. 2, 2A, and 7-12, each panel assembly 12 includes a first panel member 16, a second panel member 18, and a thermally insulating core 20. The first panel member 16 includes a front portion 22 having an outer face 24 and an inner face 26. A top portion 28 extends from a top edge margin of the front portion 22 (FIG. 9). The top portion 28 extends generally perpendicular from the front portion 22 in a direction inward away from the inner face 26. A bottom portion 30 extends from a bottom edge margin of the front portion 22 opposite the top portion 28. The bottom portion 30 extends generally perpendicular from the front portion 22 in a direction inward away from the inner face 26, such that the bottom portion and the top portion are generally in spaced, parallel alignment. A first side portion 32 extends from a first side edge margin of the front portion 22 (FIG. 8). The first side portion 32 extends generally perpendicular from the front portion 22 in a direction inward away from the inner face 26. A second side portion 34 extends from a second side edge margin of the front portion 22 opposite the first side portion 32. The second side portion 34 extends generally perpendicular from the front portion 22 in a direction inward away from the inner face 26, such that the first and second side portions are generally in spaced parallel alignment.

Each of the top, bottom, and first and second side portions 28, 30, 32, 34 of the first panel member 16 includes a mounting flange configured for attachment to the second panel member 18. A top mounting flange 38 extends generally perpendicular from the top portion 28 in a direction toward the bottom portion 30. A bottom mounting flange 40 extends generally perpendicular from the bottom portion 30 in a direction toward the top portion 28. A first side mounting flange 42 extends generally perpendicular from the first side portion 32 in a direction toward the second side portion 34. A second side mounting flange 44 extends generally perpendicular from the second side portion 34 in a direction toward the first side portion 32. The mounting flanges 38, 40, 42, 44 preferably lie in the same plane (parallel to the plane of the front portion 22) for level attachment to the second panel member 18.

The first panel member 16 can be formed as one piece from a metal blank (not shown) that is stamped from a sheet metal roll and bent into shape. The first panel member 16 can be stamped from galvanized steel, stainless steel, aluminum, or any other suitable material. The first panel member 16 is preferably formed of light gauge metal, such as 14-22 gauge metal. In one embodiment, the first panel member 16 is stamped from 20 gauge galvanized steel, although other thicknesses and other suitable materials are within the scope of the present invention.

Figure 10:
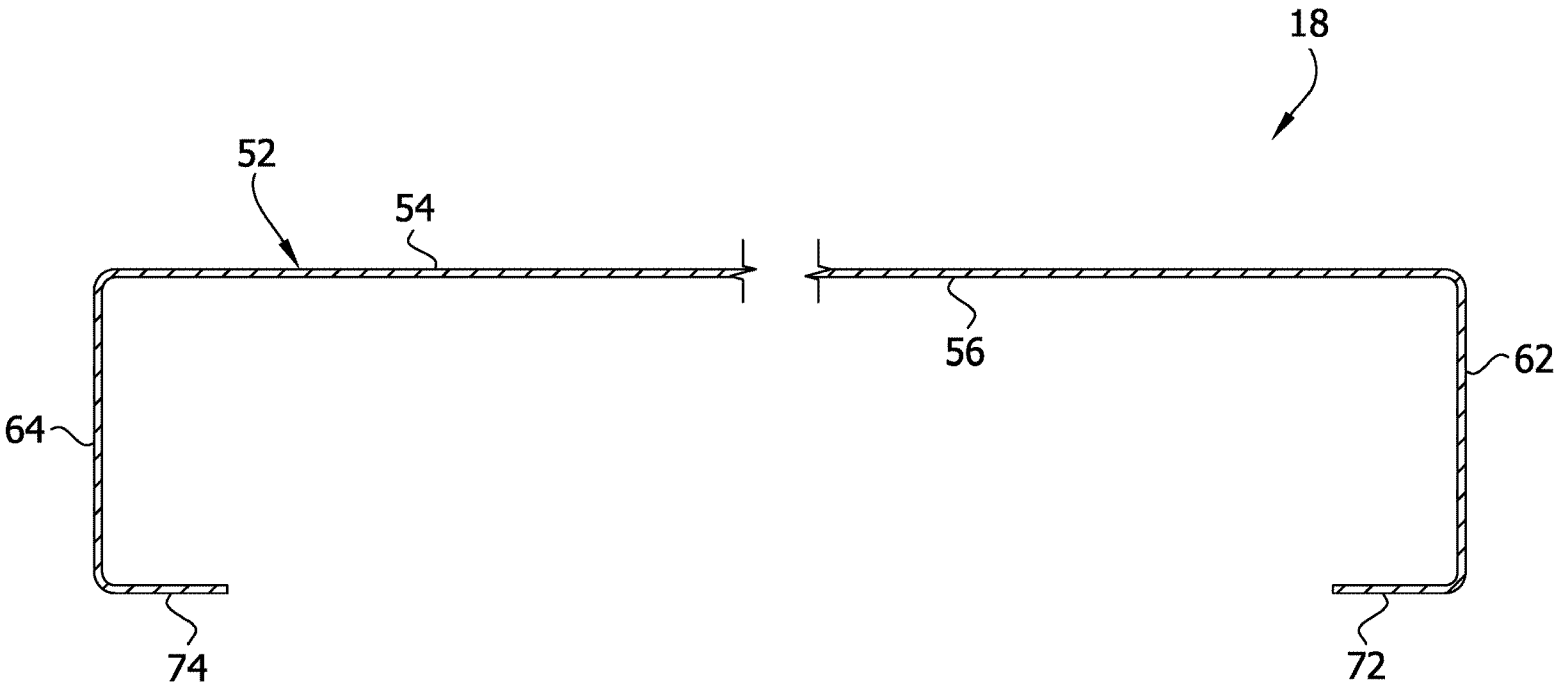
FIG. 10 is a horizontal section of a second panel member of a panel assembly of FIG. 7 with portions broken away.
Figure 11:
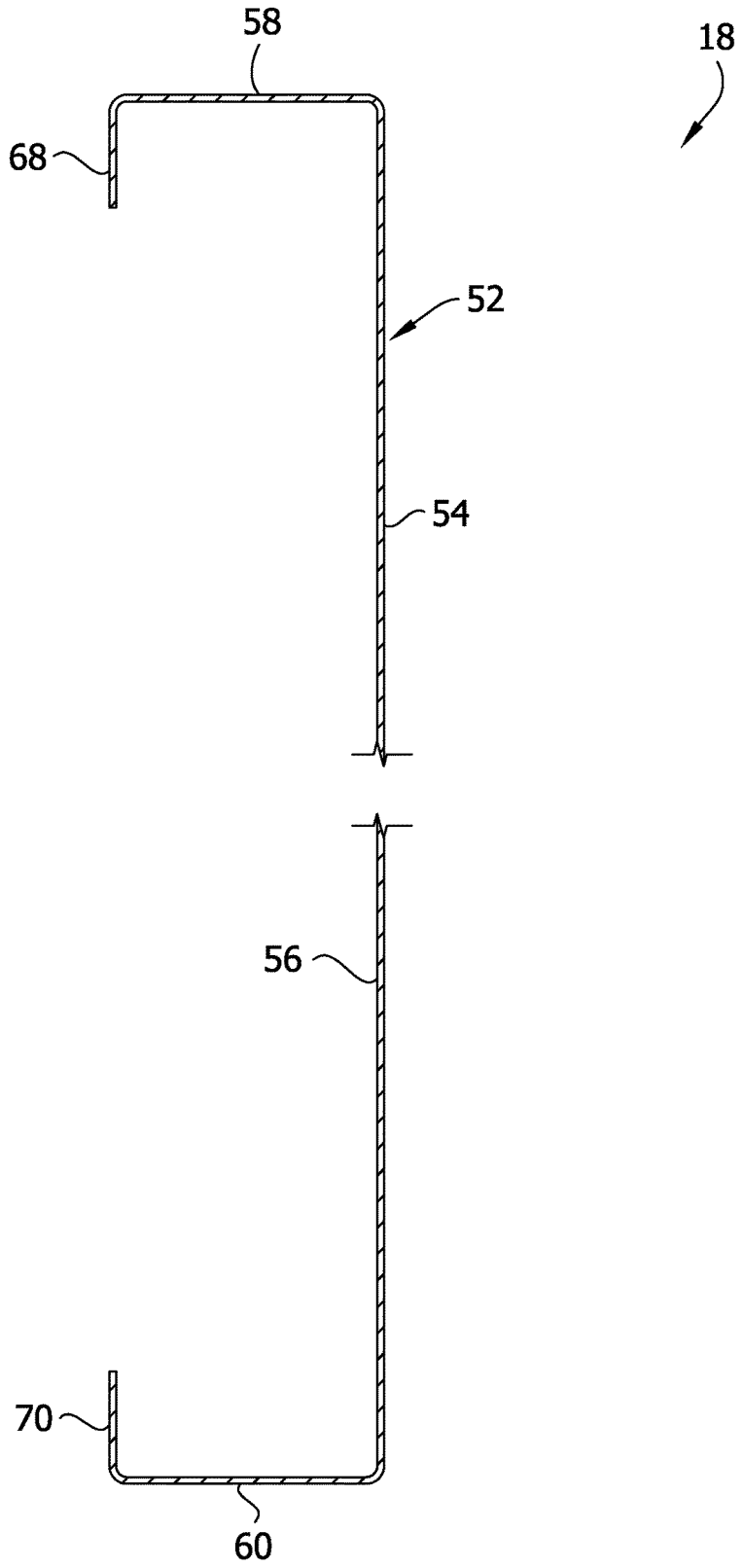
FIG. 11 is a vertical section of the second panel member of FIG. 10 with portions broken away.

Referring to FIGS. 7, 7A, 10 and 11, the second panel member 18 includes a front portion 52 having an outer face 54 and an inner face 56. A top portion 58 extends from a top edge margin of the front portion 52 (FIG. 11). The top portion 58 extends generally perpendicular from the front portion 52 in a direction inward away from the inner face 56. A bottom portion 60 extends from a bottom edge margin of the front portion 52 opposite the top portion 58. The bottom portion 60 extends generally perpendicular from the front portion 52 in a direction inward away from the inner face 56, such that the bottom portion and the top portion 58 are generally in spaced parallel alignment. A first side portion 62 extends from a first side edge margin of the front portion 52 (FIG. 10). The first side portion 62 extends generally perpendicular from the front portion 52 in a direction inward away from the inner face 56. A second side portion 64 extends from a second side edge margin of the front portion 52 opposite the first side portion 62. The second side portion 64 extends generally perpendicular from the front portion 52 in a direction inward away from the inner face 56, such that the first and second side portions are generally in spaced parallel alignment.

Referring still to FIGS. 10 and 11, each of the top, bottom, and first and second side portions 58, 60, 62, 64 of the second panel member 18 includes a mounting flange configured for attachment to the first panel member 16. A top mounting flange 68 extends generally perpendicular from the top portion 58 in a direction toward the bottom portion 60. A bottom mounting flange 70 extends generally perpendicular from the bottom portion 60 in a direction toward the top portion 58. A first side mounting flange 72 extends generally perpendicular from the first side portion 62 in a direction toward the second side portion 64. A second side mounting flange 74 extends generally perpendicular from the second side portion 64 in a direction toward the first side portion 62. The mounting flanges 68, 70, 72, 74 of the second panel member 18 preferably lie in the same plane (parallel to the plane of the front portion 52) for level attachment to the first panel member 16.

The second panel member 18 can be formed as one piece from a metal blank (not shown) that is stamped from a sheet metal roll and bent into shape. The second panel member 18 can be stamped from galvanized steel, stainless steel, aluminum, or any other suitable material. The second panel member 18 is preferably formed of light gauge material, such as 14-22 gauge material. In one embodiment, the second panel member 18 is stamped from 18 gauge galvanized steel, although other thicknesses and other suitable materials are within the scope of the present invention. The second panel member 18 and the first panel member 16 may be formed of the same material or different materials and may have the same thickness or different thicknesses.

To form the insulated panel assembly 12, one of the first and second panel members 16, 18 can be laid down in a jig (not shown) or simply on the floor. For purposes of this description we will refer to second panel member 18 as being laid down. A gasket 78 or gaskets (broadly, "spacer (s)") are laid on top of the mounting flanges 68, 70, 72, 74 to provide a thermal barrier and a spacing between the first and second panel members 16, 18. The first panel member 16 is laid upon the second panel member 18 so that the mounting flanges 38, 40, 42, 44 of the first panel member face the mounting flanges 68, 70, 72, 74 of the second panel member. The mounting flanges of the first and second panel members 16, 18 do not engage, but are separated by the gasket 78. The first and second panel member 16, 18 can be temporarily secured together using tape or clamps (not shown). It is also possible that no temporary securement is employed. Together, the first and second panel members 16, 18 form a housing that has inner and outer major surfaces (corresponding to the outer faces 24, 54 of the panel members). Edge surfaces of the housing extend between the major surfaces. The edge surfaces are mostly defined by the side portions 32, 34, 62, 64 of the first and second panel members 16, 18.

The panel subassembly is taken to a press (not shown) for injection of material to form the insulating core 20 into the cavity 82 defined by the first and second panel members 16, 18. For example, in one embodiment, the assembled first and second panel members 16, 18 are placed in a heated press and the cavity 82 is injected with urethane foam to form the core 20 having a density of about 2.5 lbs/ft$^3$ (40.05 kg/m$^3$). The thermal insulating core 20 can comprise other suitable insulating materials or other suitable densities within the scope of the present invention. The press is capable of holding the first and second panel members 16, 18 in position with respect to each other and to hold them from being pushed apart or having their front portions 22, 52 bow out under the pressure of the insulation material forming the core 20 being injected. The material of the insulating core 20 operates as an adhesive joining the first and second panel members 16, 18 together permanently.

Figure 12:
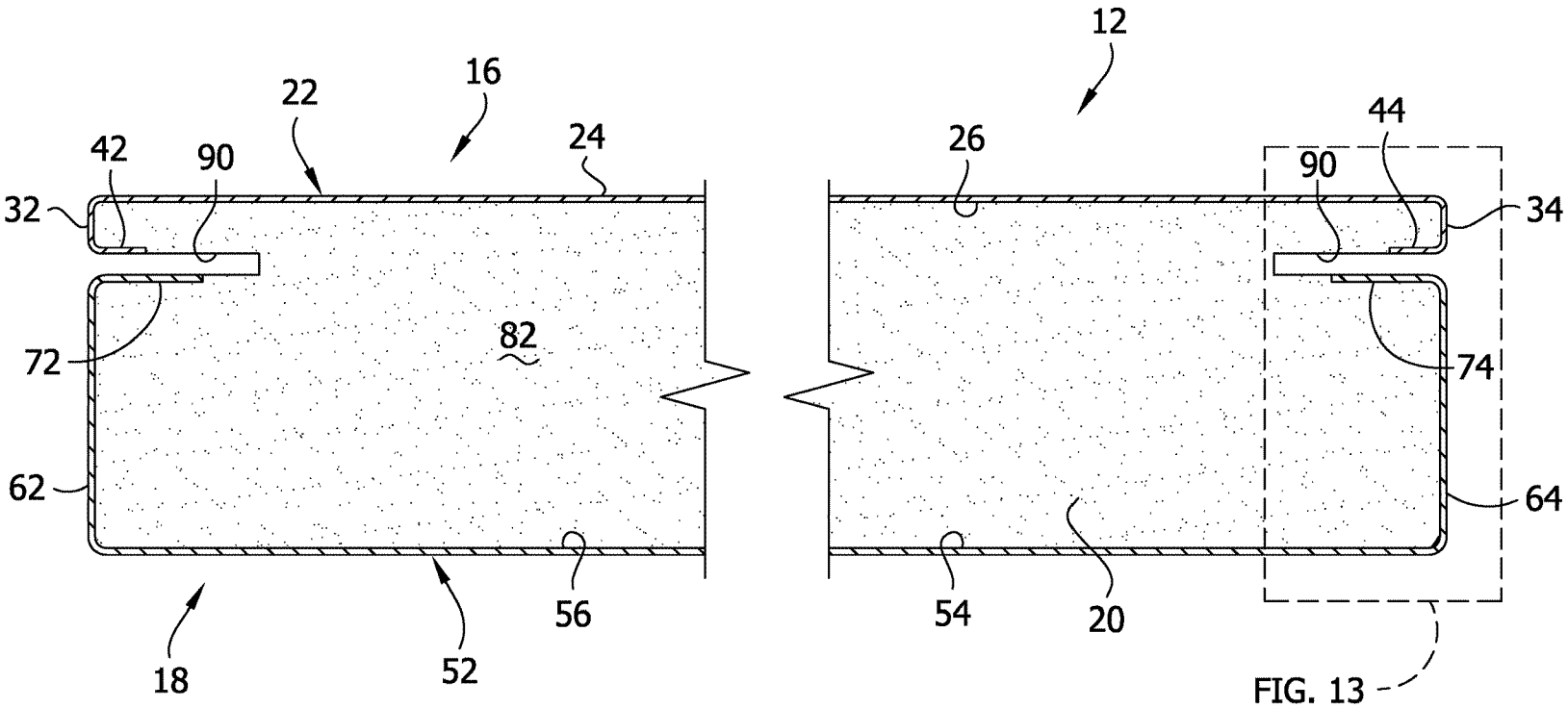
FIG. 12 is a horizontal section of the panel assembly of FIG. 7.
Figure 13:
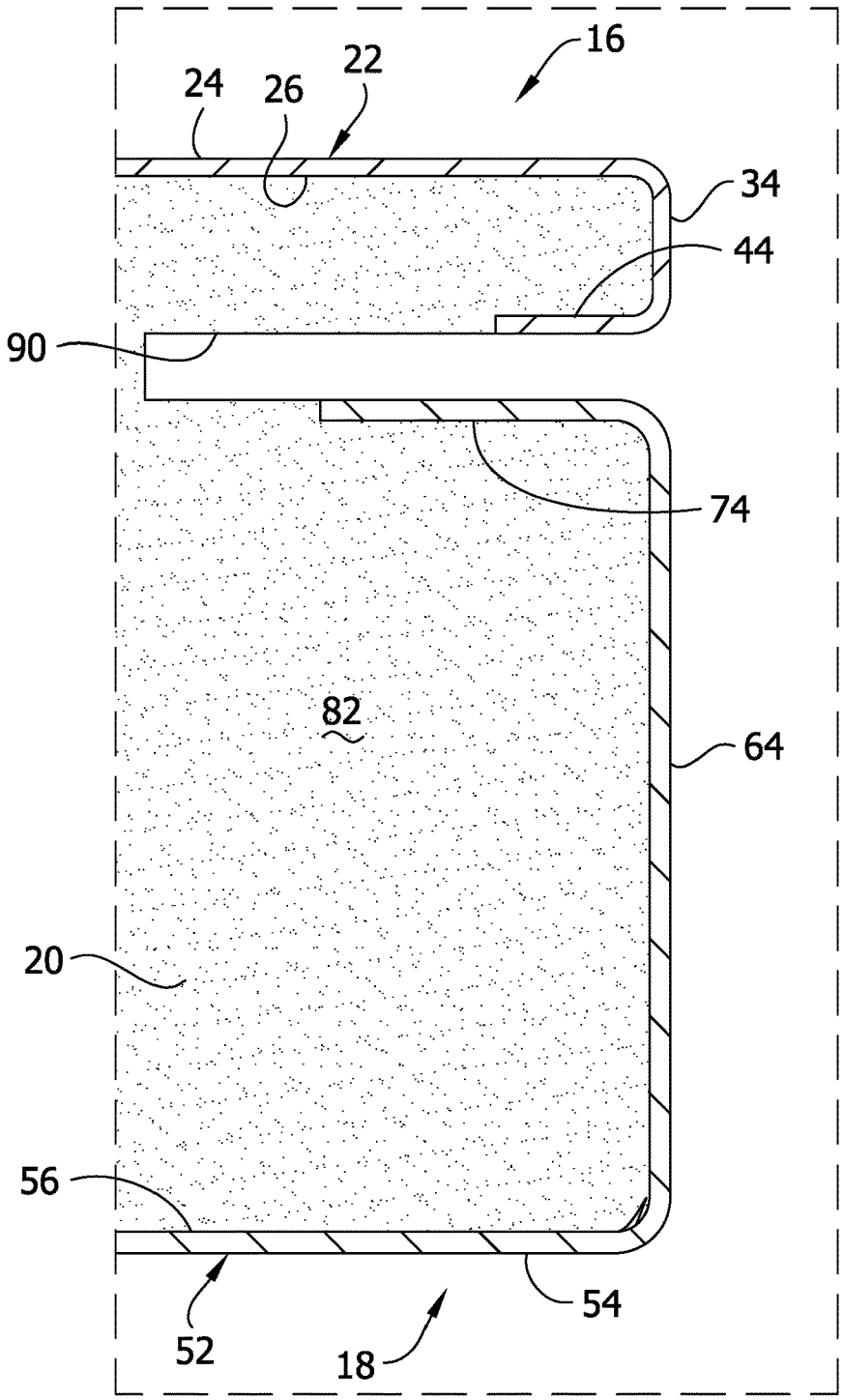
FIG. 13 is an enlarged fragmentary portion of FIG. 12.
Figure 14:
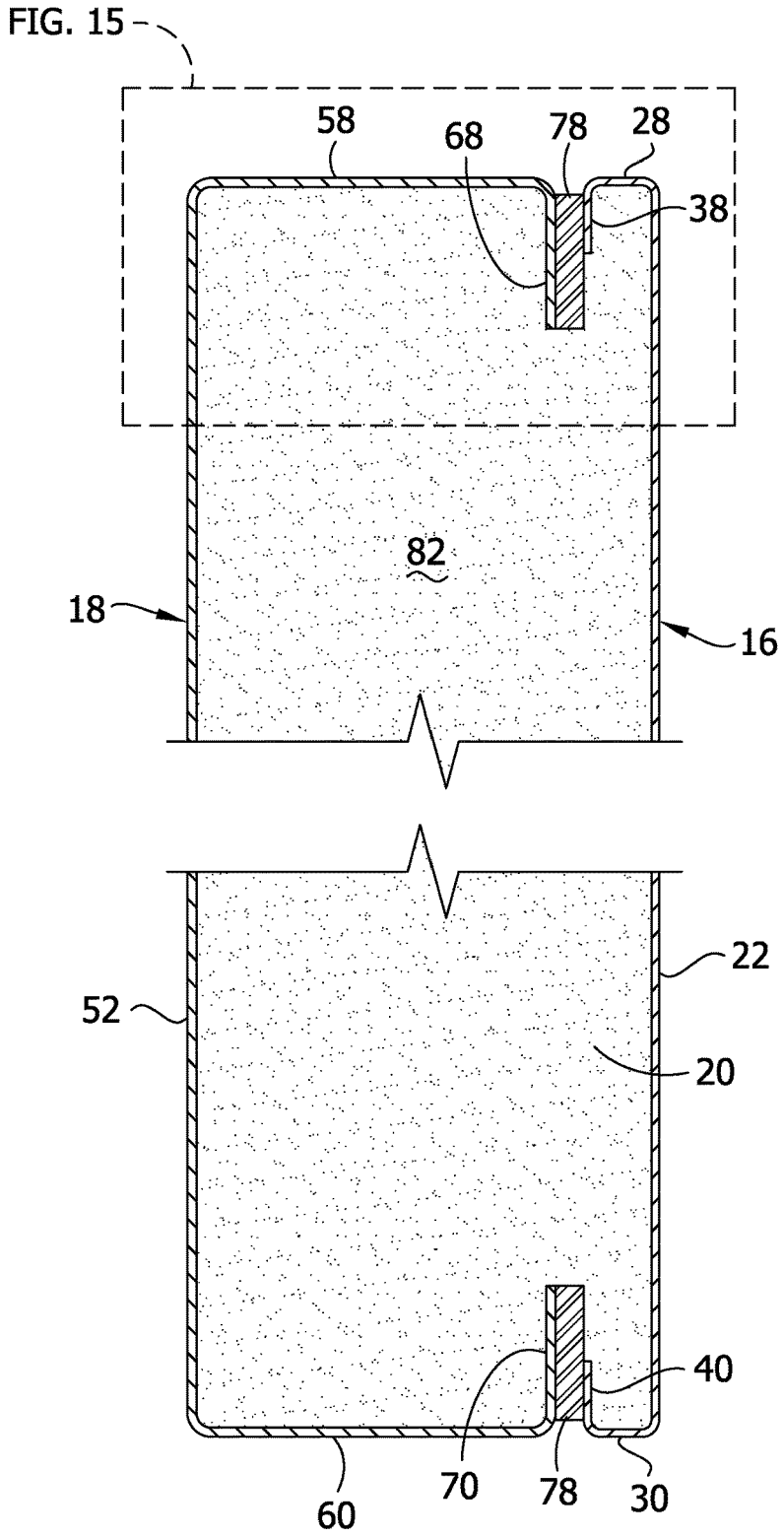
FIG. 14 is a vertical section of the panel assembly of FIG. 7.
Figure 15:
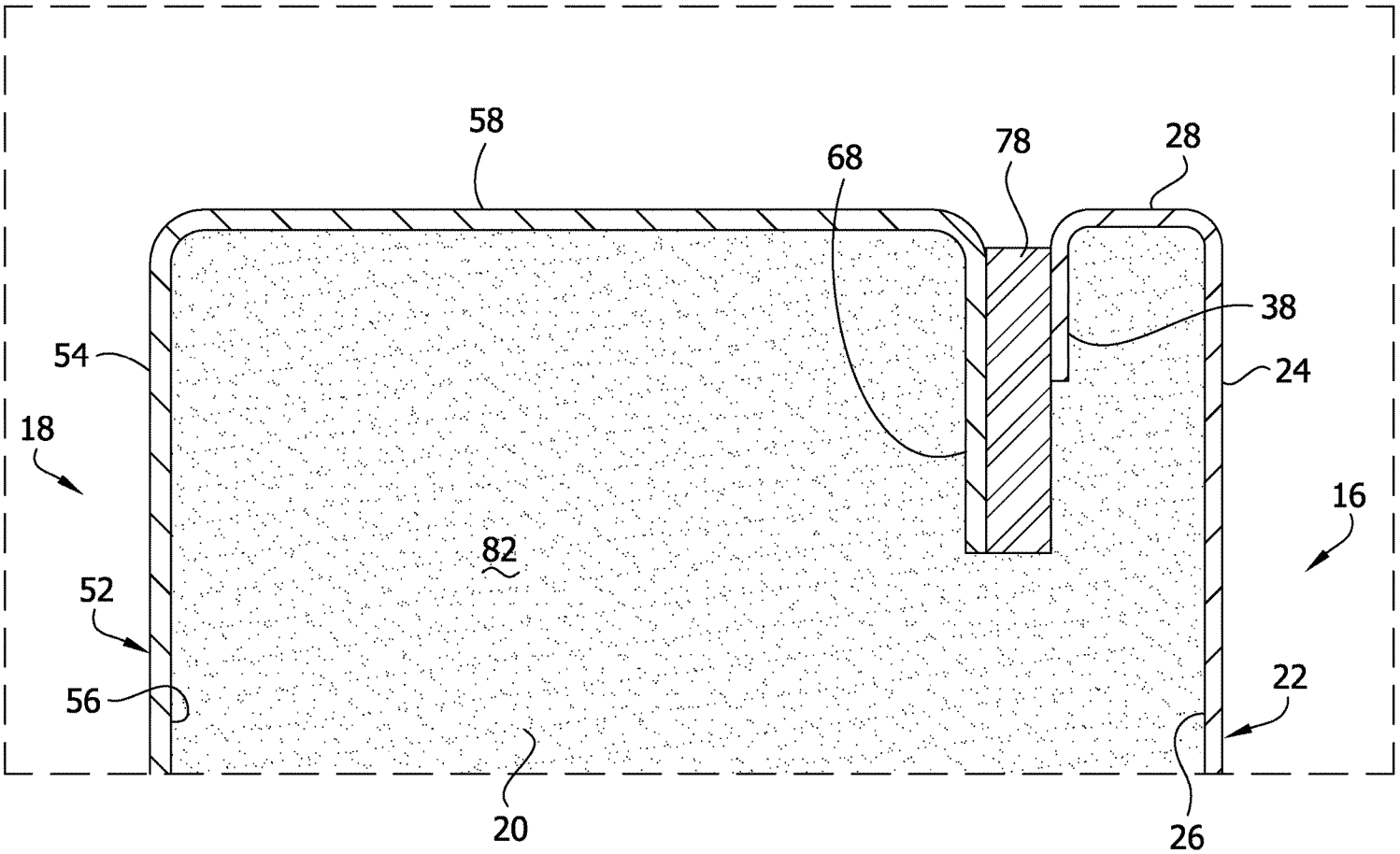
FIG. 15 is an enlarged fragmentary portion of FIG. 14.

The panel assembly 12 is taken from the press and a cut is made between the panel members 16, 18 on both sides. The cut effectively removes the gasket 78 on the side and leaves a slot 90 on each side of the panel assembly 12 that extends into the panel assembly toward the interior cavity 82 between the opposed mounting flanges 42, 72 or 44, 74, and past the respective mounting flange 72 or 74 of the second panel member. In the illustrated embodiment, the slot extends the full length of the side of the panel assembly 12. The purpose of the slot 90 will be described hereinafter. As finally assembled, the first and second panel members 16, 18 are attached together such that the inner face 26 of the first panel member 16 is spaced from and opposes the inner face 56 of the second panel member 18, forming the cavity 82 that holds the insulated core 20. The edge margins of the first panel member 16 are aligned with the corresponding edge margins of the second panel member 18. In particular, the top edge margin of the first panel member 16 is aligned with the top edge margin of the second panel member 18, the bottom edge margin of the first panel member is aligned with the bottom edge margin of the second panel member, and the first and second side edge margins of the first panel member are aligned with the first and second side edge margins of the second panel member. For example, it may be seen in FIG. 14 that the top portion 28 of the first panel member 16 is laterally aligned with the top portion 58 of the second panel member 18. Similarly, the bottom portion 30 of the first panel member 16 is laterally aligned with the bottom portion 60 of the second panel member 18. As shown in FIG. 12, the first side portion 32 of the first panel 16 is laterally aligned with the first side portion 62 of the second panel 18, and the second side portion 34 of the first panel member is laterally aligned with the second side portion 64 of the second panel member. It will be appreciated that other ways of assembling the panel assembly 12 may be used within the scope of the present invention.

Figure 4:
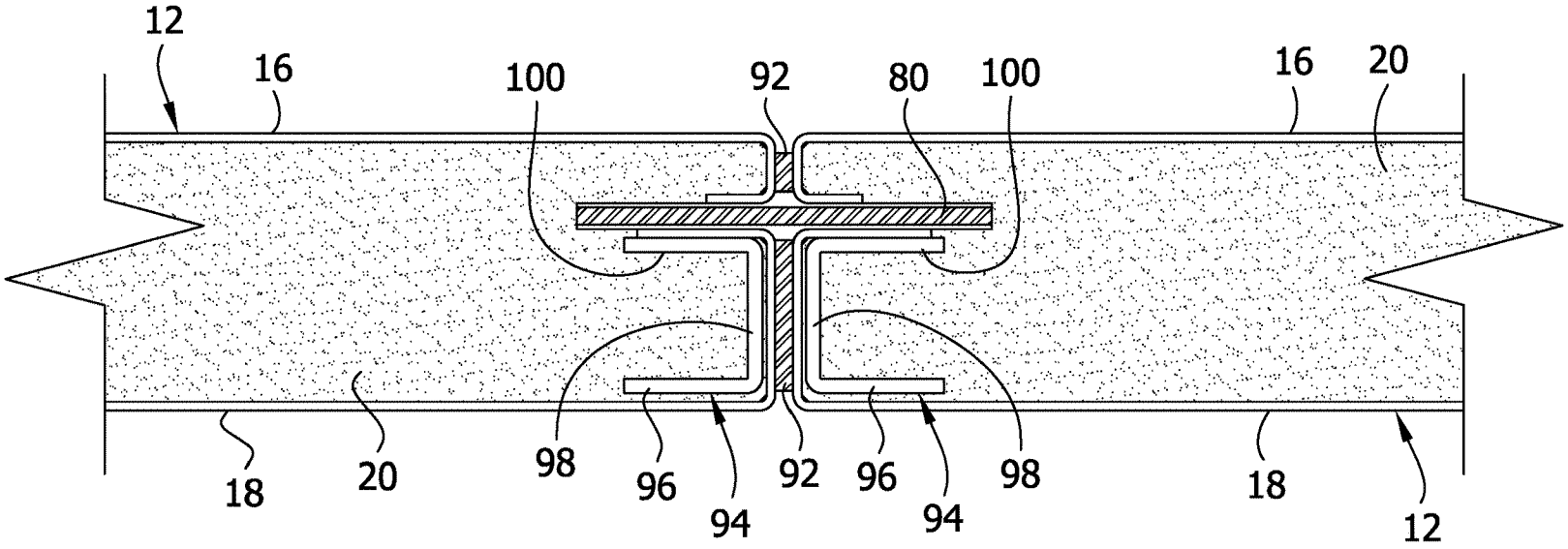
FIG. 4 is an enlarged fragmentary portion of FIG. 2 showing panel assemblies forming a side of the thermally insulated enclosure.
Figure 4A:
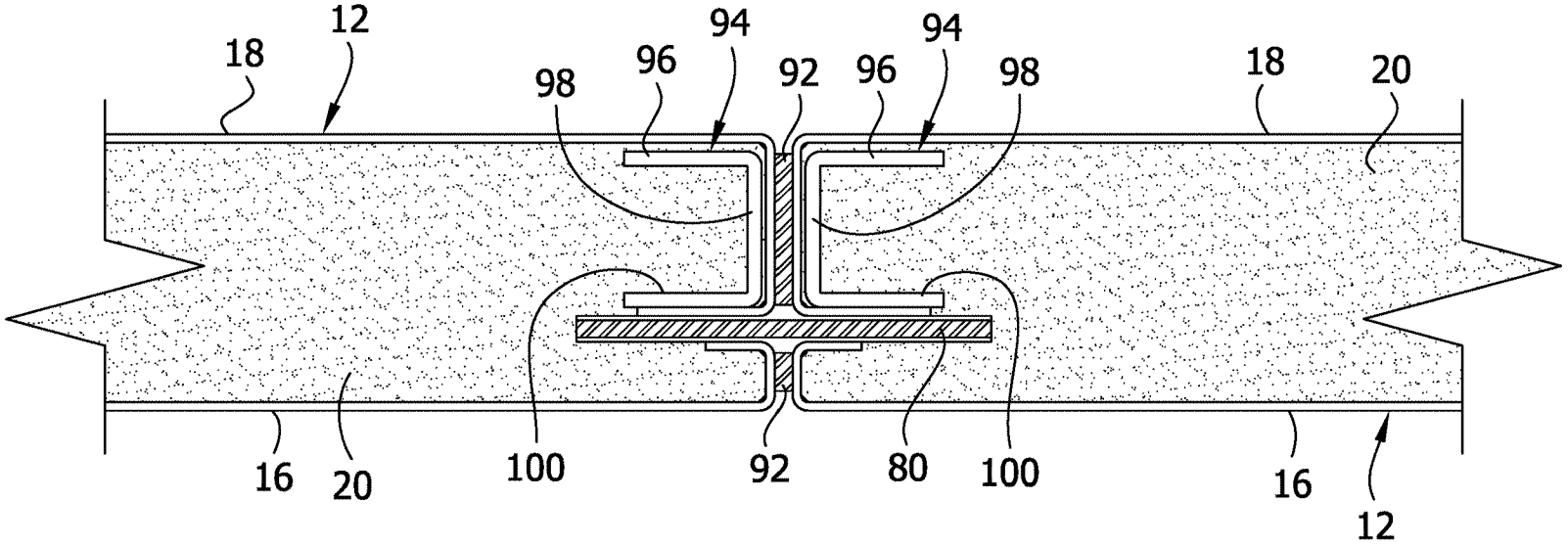
FIG. 4A is an enlarged fragmentary portion of FIG. 2A showing panel assemblies forming a side of the thermally insulated enclosure.

Referring to FIGS. 4 and 4A, a stiffener 94 may be disposed in the cavity 82 of each panel assembly 12. At least one stiffener may be disposed within the cavity 82 of a panel assembly 12. In some embodiments, two stiffeners 94 are disposed within the cavity 82 of a panel assembly 12. In the embodiment shown in FIG. 4, the stiffeners 94 are disposed in opposed side edge margins in the second panels 18 of adjacent panel assemblies 12 between the mounting flange 72 and the inner face 56 and between mounting flange 74 and the inner face 56. Each stiffener 94 comprises a U shaped channel member received within a side edge margin of the second panel 18 of a panel assembly. As shown in FIGS. 4 and 4A, a first section 96 of the stiffener 94 extends generally parallel to the front portion 52 along the inner face 56 of the front portion. A second section 98 extends from the first section 96 along the second side portion 64 generally parallel to the second side portion. A third section 100 extends from the second section 98 along the second side mounting flange 74 generally parallel to the second side mounting flange. A stiffener 94 may also be disposed in the opposing side margin of the second panel 18 of the adjacent panel assembly 12. In the embodiment shown in FIG. 4A, the second panels 18 of adjacent panel assemblies 12 are disposed on an outer side of the assemblies. The stiffeners 94 have the same construction as those shown in FIG. 4.

Panel assemblies identical to panel assembly 12 can be taken to a site for construction of an insulated enclosure 10. In the illustrated embodiment, each panel assembly 12 has a rectangular parallelepiped configuration. The panel assembly 12 is free of any outwardly projecting structure. The panel assemblies 12 can be used to rapidly construct the enclosure 10, as will be described. A feature of this construction is the use of elongate, thermally insulating slats 80. Referring to FIG. 4, one of the slats can be inserted edgewise into the slot 90 on one side of a first of the panel assemblies 12. The slat 80 has a length substantially equal to the height of the panel assembly 12. The slat 80 is received with a friction or interference fit in the slot 90 to at least temporarily hold the slat in the slot. Gasket 78 is selected to have a thickness so that it spaces the mounting flanges of the first and second panel members to ultimately provide that the slot 90 has an appropriate width for fitting the slat 80. In the illustrated embodiment, the fit is such that the slat 80 can be held in the slot 90, but is not so tight as to prevent manual removal. The next adjacent (second) panel assembly 12 can be placed next to the first panel assembly so that the projecting portion of the slat 80 is received in the slot 90 of the second panel assembly. Caulk 92 is located between the adjacent panel assemblies 12 to facilitate an air tight connection between them. Typically, the caulk 92 is applied to one of the panel assemblies 12 before connection to another of the panel assemblies. It will be appreciated that this procedure can be continued for each subsequent panel assembly 12 until a side wall of a desired length has been constructed. No conventional fasteners (e.g., screws) are required to make connection between adjacent panel assemblies 12. The use of the construction of panel assemblies 12 and slats 80 can reduce the time to assemble the panel assemblies to form the enclosure 10 by about 85% (e.g., from about 35 minutes to about 5 minutes).

The slats 80 connecting adjacent panel assemblies 12 do not significantly resist the panel assemblies being pulled apart in the plane of the side wall of the enclosure 10, but do hold the connected panel assemblies from movement with respect to each other out of the plane of the enclosure side wall. The slats 80 can be formed of any suitable material, such as a thermoplastic polymer. Examples of suitable material include, without limitation, Lexan™, Acrylonitrile Butadiene Styrene (ABS), polyvinyl chloride (PVC), fiberglass, etc.

A more complete description of the construction of the thermally insulated enclosure 10 will now be provided. A base 13 comprising the framing channel 14 and floor 15 is constructed to have the dimensions of the footprint of the thermally insulated enclosure 10. In the illustrated embodiment, an angle iron 14A is mounted on a top flange of the framing channel. Lips 15A (only one of which is shown) are formed by upturned portions of the floor 15 around its perimeter. The angle iron 14A and lip 15A are used to locate the panel assemblies 12 forming the side walls of the enclosure 10 as will be described. The base 13 will have any drains or other features (not shown) required for the particular application. The base will be brought into place or constructed at the location where the thermally insulated enclosure is to be erected.

In one embodiment, two panel assemblies 12 are positioned at right angles to each other. For purposes of this description, the two panel assemblies 12 are those shown in the upper left hand corner of the enclosure in FIG. 2. The two panel assemblies 12, shown on a larger scale in FIG. 3, have an arrangement where the first panel member 16 is the outer panel member and the second panel member 18 is the inner panel member. FIG. 3A shows the panel assemblies 12 having an arrangement where the first panel member 16 is the inner panel member and the second panel member 18 is the outer panel member. In both instances, the panel assemblies 12 are connected using an interior angle member 102, an exterior bracket 104, and a corner flashing 106.

The interior angle member 102 is L-shaped in cross section and extends generally from the bottom edge margins of the corner panel assemblies 12 to the top edge margins of the panel assemblies. The interior angle member 102 has a first leg 103 that extends along the front portion 52 of a second panel member 18 of a first corner panel assembly 12, and a second leg 105 that extends generally perpendicular from the first leg along the front portion 52 of a second panel member 18 of an abutting second corner panel assembly 12. The legs 103, 105 of the interior angle member 102 are screwed into the panel members 18 using screws 108. Caulk (not shown) may be provided between the first angle 102 and the second panel members 18 preventing metal-to-metal contact between the interior angle member 102 and second panel members 18, and helping to form an air tight seal along the corner.

The exterior bracket 104 extends generally from the bottom edge margins of the corner panel assemblies 12 to the top edge margins of the panel assemblies. The exterior bracket 104 is generally channel-shaped, including a first section 110 that extends along the first side portions 32, 62 of the first and second panel members 16, 18 of the first corner panel assembly 12, and a second section 112 that extends generally perpendicular from the first section along the second side portions 34, 64 of the first and second panel members 16, 18 of the abutting second corner panel assembly 12. Gaskets 113 are disposed between the first section 110 and the first side portions 32, 62 of the first corner panel assembly 12, and between the second section 112 and the second side portions 34, 64 of the second corner panel assembly 12 to prevent metal-to-metal contact thus providing a thermal break between the exterior bracket 104 and the panel assemblies 12. In the arrangement in FIG. 3, the first section 110 of the exterior bracket 104 is screwed into the first side portion 32 of the first panel member 16 of the first corner panel assembly 12 using screws 108, and the second section 112 of the exterior bracket is screwed into the second side portion 64 of the second panel member 18 of the second corner panel assembly 12 using screws 108. The interior angle member 102 and exterior bracket 104 extending substantially the full heights of the panel assemblies 12. The interior angle member 102 and exterior bracket 104 are connected to the respective first and second corner panel assemblies by screws 108 at intervals along the height.

In the FIG. 3A arrangement, the first section 110 of the exterior bracket 104 is screwed into the first side portion 62 of the second panel member 18 of the first corner panel assembly 12 using screws 108, and the second section 112 of the exterior bracket is screwed into the second side portion 64 of the second panel member 18 of the second corner panel assembly 12 using screws 108. In both the FIGS. 3 and 3A arrangements, a first flange 114 extends generally perpendicular from the first section 110 of the exterior bracket 104 away from the first corner panel assembly 12, and a second flange 116 extends generally perpendicular from the second section 112 of the exterior bracket toward the second corner panel assembly 12. In the FIG. 3 arrangement, the second flange 116 extends along the outer surface 24 of the front portion 22 of the first panel member 16 of the second corner panel assembly 12. In the FIG. 3A arrangement, the second flange 116 extends along the outer surface 54 of the front portion 52 of the second panel member 18 of the second corner panel assembly 12. The first and second flanges 114, 116 strengthen the exterior bracket 104 against bending about axes perpendicular to its length.

The corner flashing 106 extends generally from the bottom edge margins of the corner panel assemblies 12 to the top edge margins of the panel assemblies. The flashing 106 includes a first section 118 attached to the first corner panel assembly 12 using screws 108, and a second section 120 extending generally perpendicular from the first section toward the second corner panel assembly 12. The second section 120 is attached to the second corner panel assembly using screws 108. A first flange 122 is bent from the first section 118 and extends generally parallel to the first section. A second flange 124 is bent from the second section 120 and extends generally parallel to the second sections. The screws 108 attaching the first and second sections 118, 120 to the panel assemblies 112 extend through both the first and second sections and the first and second flanges 122, 124. The first and second flanges help to prevent enlargement of or tearing of the flashing 106 at the hole formed by the screw.

Figure 3:
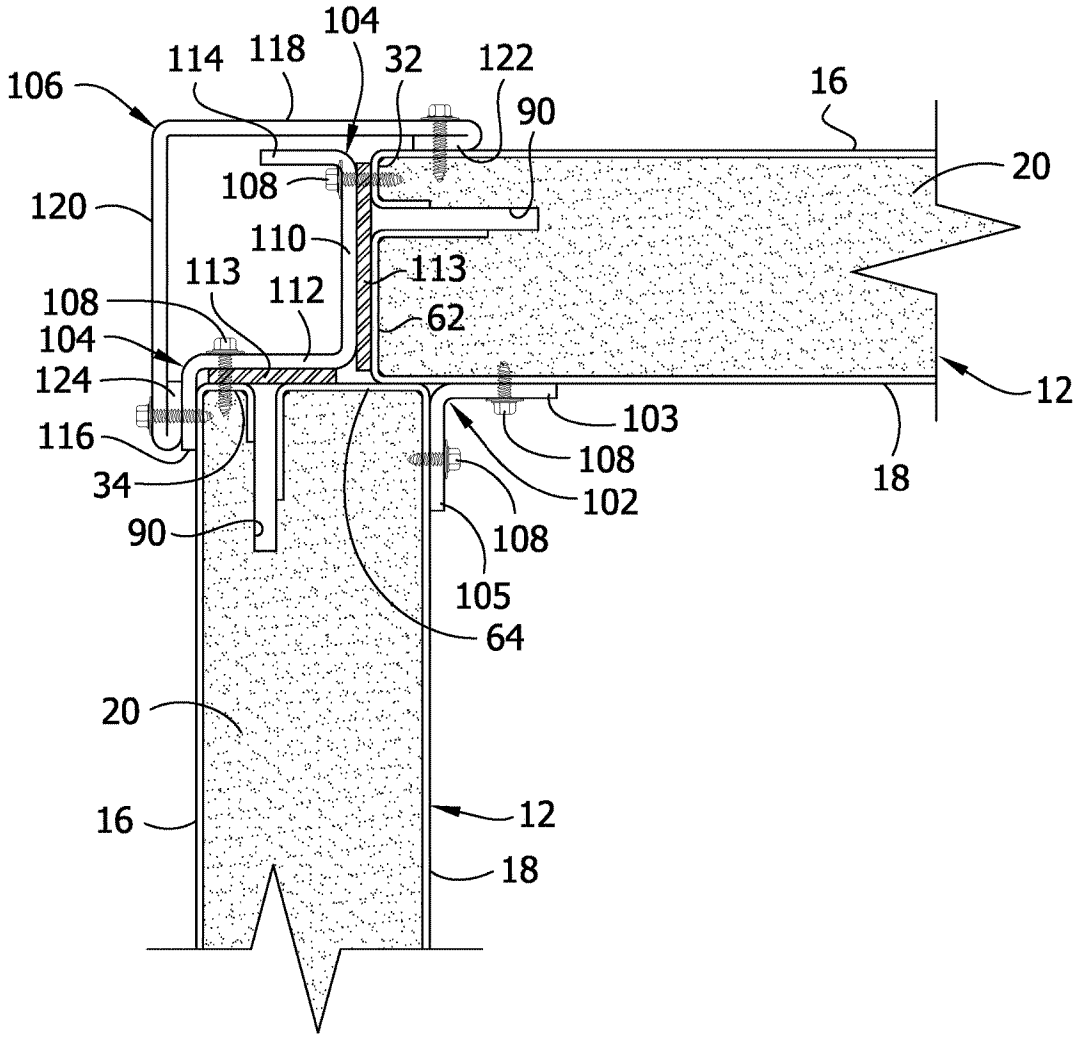
FIG. 3 is an enlarged fragmentary portion of FIG. 2 showing a corner connection.
Figure 3A:
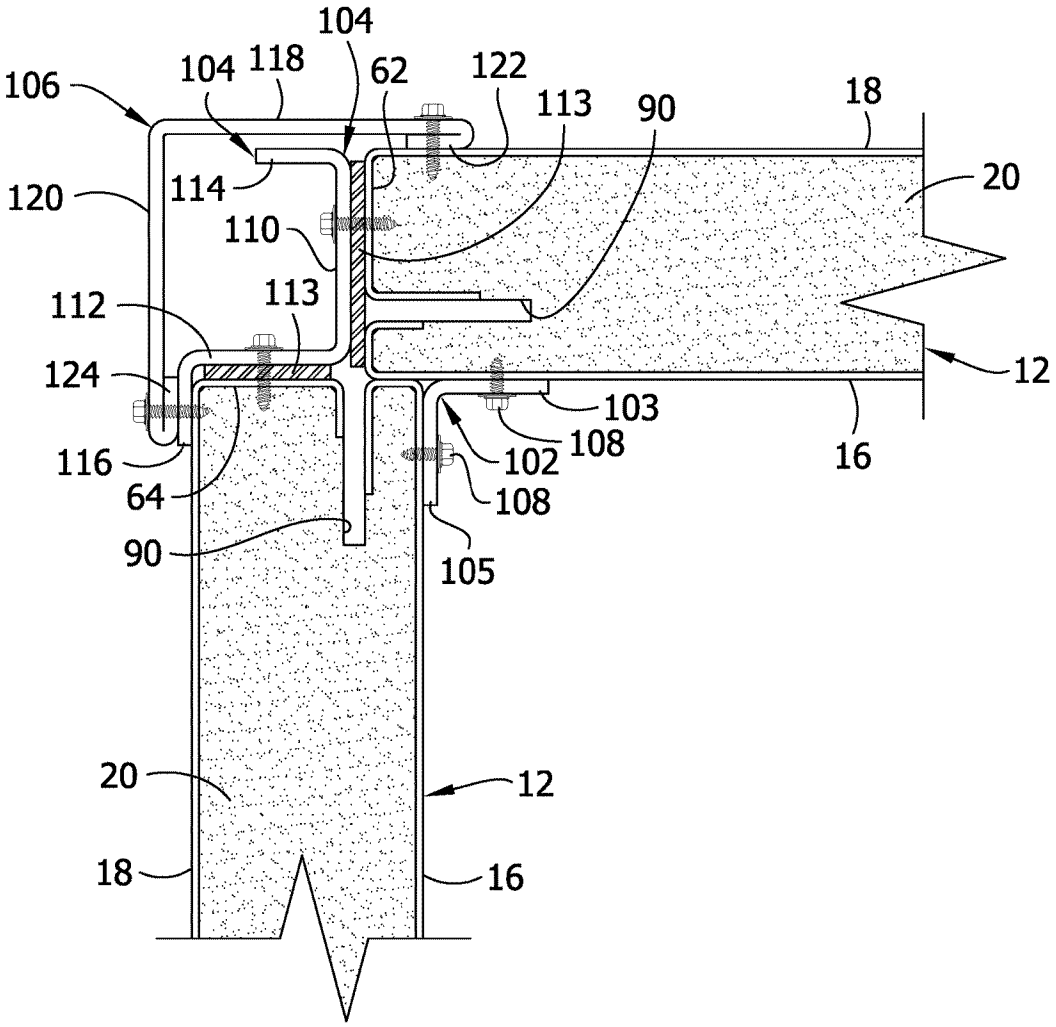
FIG. 3A is an enlarged fragmentary portion of FIG. 2A showing a corner connection.

In the FIG. 3 arrangement, the first section 118 and first flange 122 are attached to the outer surface 24 of the front portion 22 of the first panel member 16 of the first corner panel assembly 12 using screws 108, and the second section 120 and second flange 124 are attached to the outer surface 24 of the front portion 22 of the first panel member 16 of the second corner panel assembly 12 using screws 108. In the FIG. 3A arrangement, the first section 118 and first flange 122 are attached to the outer surface 54 of the front portion 52 of the second panel member 18 of the first corner panel assembly 12 using screws 108, and the second section 120 and second flange 124 are attached to the outer surface 54 of the front portion 52 of the second panel member 18 of the second corner panel assembly 12 using screws 108. In one embodiment, the flashing 106 is not applied until after the enclosure 10 is constructed. The flashing 106 may be made out of any suitable material, such as extruded aluminum that provides an aesthetically pleasing appearance.

Figure 5:
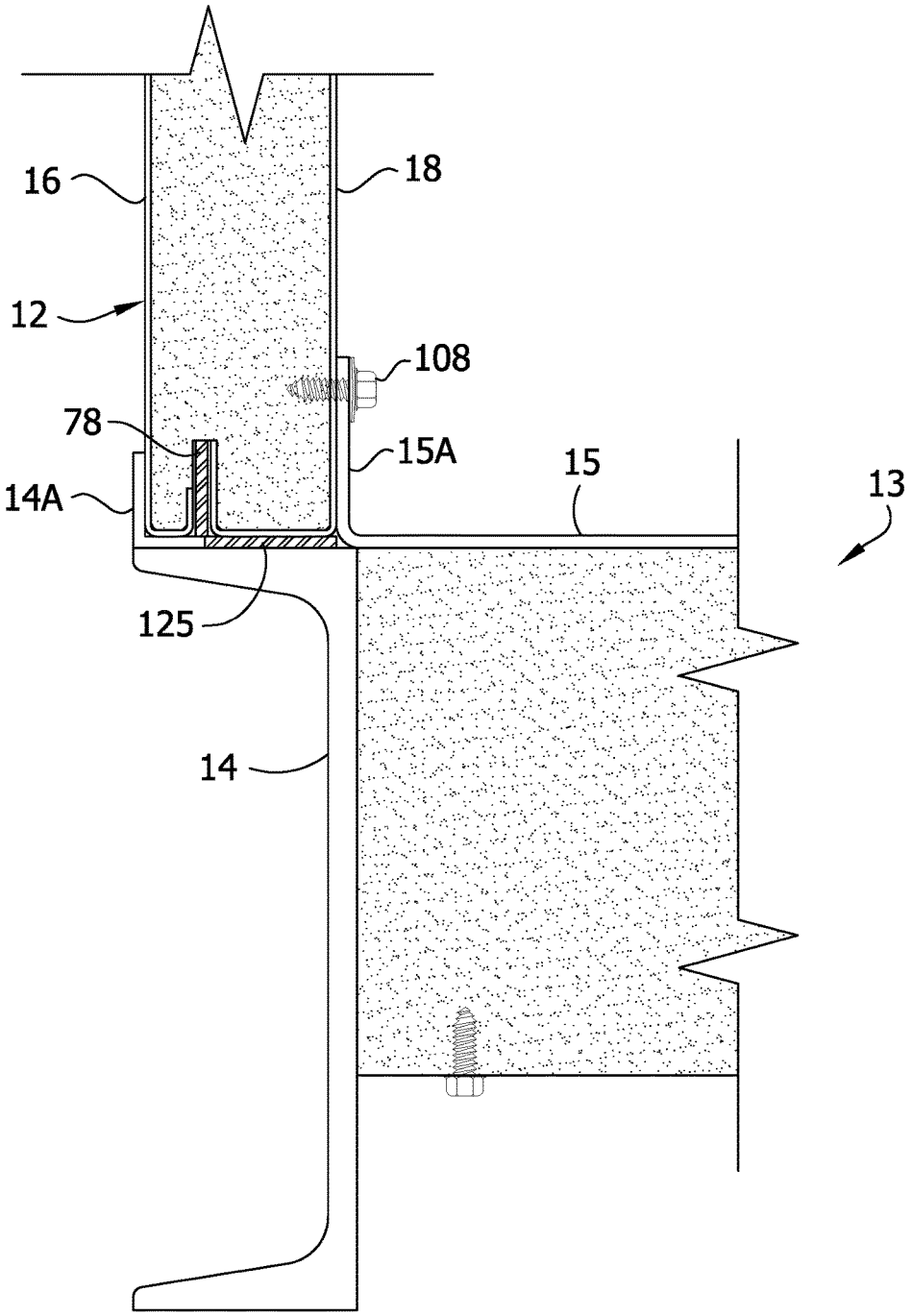
FIG. 5 is a fragmentary vertical section of the thermally insulated enclosure of FIG. 1 showing a panel assembly to base connection.
Figure 5A:
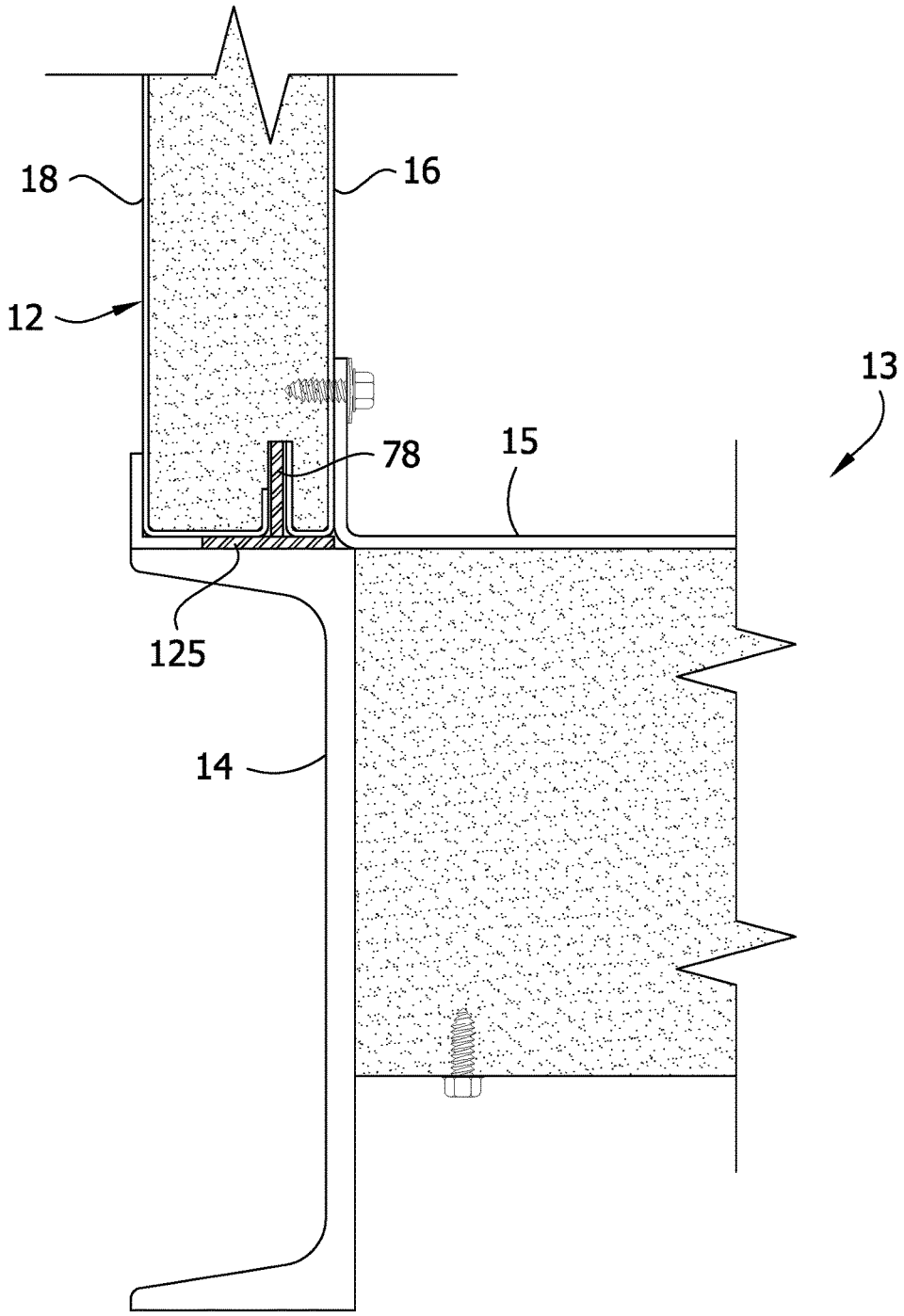
FIG. 5A is a fragmentary vertical section similar to FIG. 5, but showing an alternate panel assembly to base connection.

The assembled first and second panel assemblies 12 can be lifted up onto the base 13 of the enclosure 10. Referring to FIG. 5, each of the panel assemblies 12 is received on a top wall of a respective one of the framing channels 14 of the base 13. The panel assembly 12 is received between the angle iron 14A and the lip 15A of the floor 15 and is thereby located on the base 13. The connection is further secured by drilling screws through the lip 15A and into the panel assembly 12. Although not shown, screws may be drilled through the angle iron 14A and into the panel assembly 12 from the exterior to further secure the panel assembly to the base 13. Prior to placing the first and second panel assemblies 12 on the base, a gasket 125 is laid down on the top wall of the framing channel 14. The gasket 125 provides a thermal break between the panel assembly 12 and the framing channel 14. Also, caulk (not shown) may be applied between the lip 15A and the panel assembly 12 to inhibit heat transfer from the floor.

Once the first and second corner panel assemblies 12 forming one corner of the enclosure 10 are mounted on the base 13, side walls of the enclosure can be formed using other panel assemblies 12 of the same construction. It will be understood that other corners of the enclosure 10 could be formed in the same way and mounted on the base 10 prior to forming the side walls. The precise order of construction can be varied from what is described herein within the scope of the present invention. Formation of the side walls of the enclosure 10 can be carried out rapidly. A thermally insulating slat 80 can be inserted into the slot 90 of the second panel assembly 12 at the upper left hand corner of the enclosure being formed. A third panel assembly 12 can be placed on the base 13 so that a projecting portion of the slat 80 is received in the slot 90 of that panel assembly. The bottom of the third panel assembly 12 is received in the space between the angle iron 14A and the lip 15A of the floor 15 and secured with screws 108. There is no direct fixed attachment (e.g., as by fasteners or welding) of the third panel assembly 12 to the second panel assembly. The slat 80 has sufficient strength to hold them in plane with each other as the construction continues.

It will be appreciated that construction of the side wall of the enclosure 10 may continue rapidly. FIGS. 4 and 4A illustrate the connections between the third and a fourth side wall panel assembly 12. FIG. 4 shows the third and fourth panel assemblies 12 having an arrangement where the first panel member 16 is the outer panel member and the second panel member 18 is the inner panel member. FIG. 4A shows the panel assemblies 12 turned around, where the first panel member 16 is the inner panel member and the second panel member 18 is the outer panel member. The adjacent panel assemblies 12 are attached using another one of the thermally insulated slats 80 that extends between the edge surfaces of the adjacent panel assemblies. In the same way the second and third panel assemblies 12 where connected, another thermally insulating slat 80 is inserted into the slot 90 along the vertical edge of the third panel assembly 12. Caulk 92 is applied to the fourth panel assembly on opposite sides of the slat 80. As shown in FIG. 4, caulk 92 is applied to the side portion 32 of the first panel member 16 and to the side portion 62 of the second panel member 18. The fourth panel assembly 12 is placed on the base 13 so that the projecting portion of the slat 80 is received in the slot 90 of the fourth panel assembly. The caulk 92 is compressed between the third and fourth panel assemblies and forms a seal. The slat 80 extending between the third and fourth panel assemblies 12 also helps to block air flow. The fourth panel assembly 12 can be attached to the angle iron 14A and lip 15A of the floor 15 in the same way as the third panel assembly using screws 108.

Figure 6:
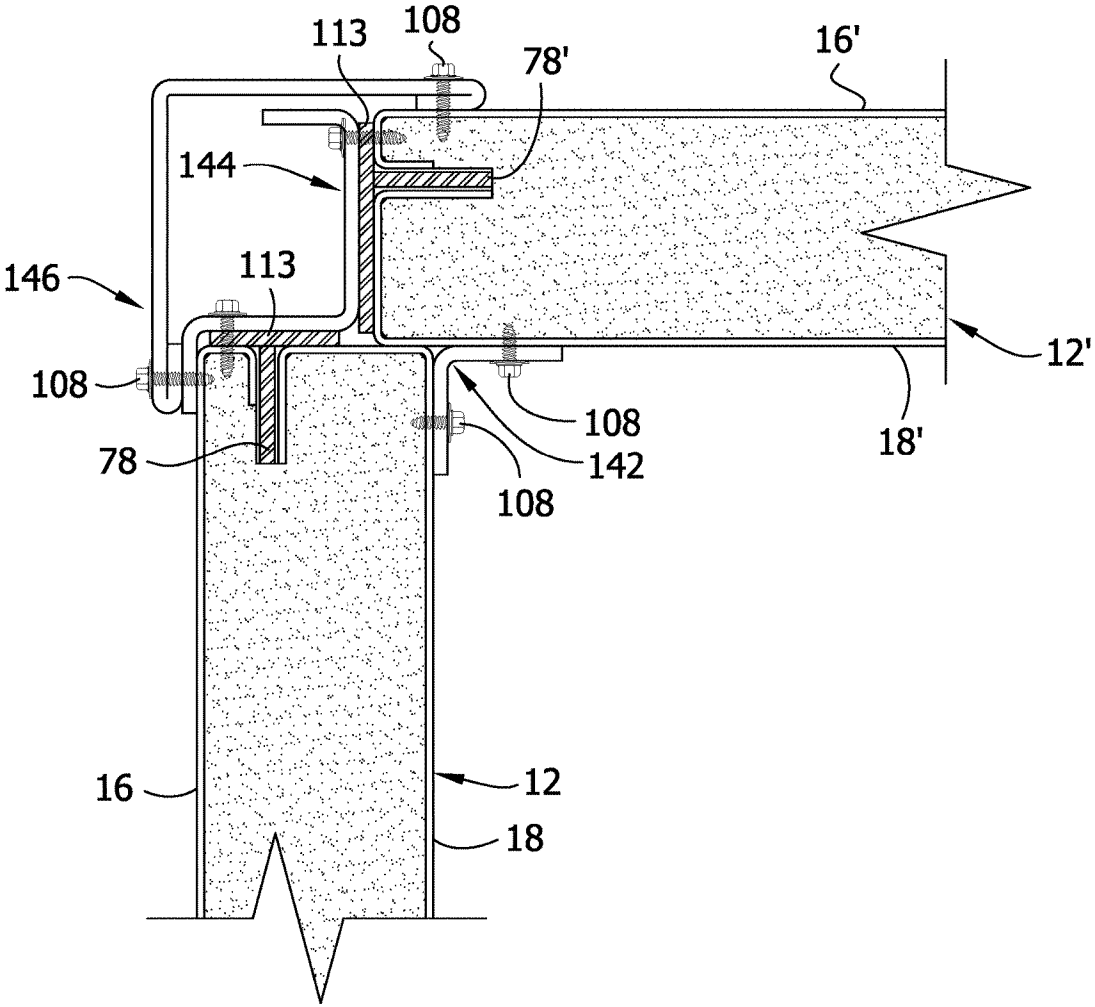
FIG. 6 is a fragmentary vertical section of the thermally insulated enclosure of FIG. 1 showing connection of a side panel assembly to a roof panel assembly.
Figure 6A:
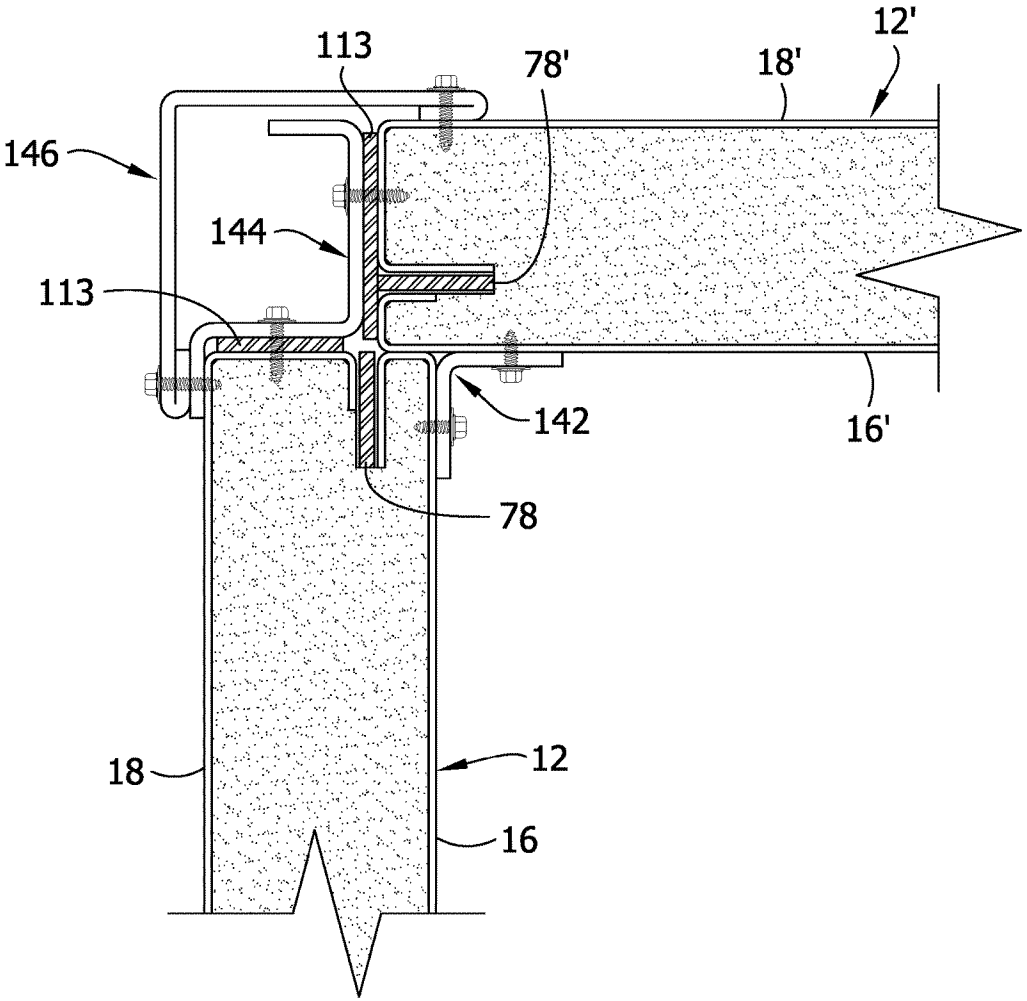
FIG. 6A is a fragmentary vertical section similar to FIG. 6, but showing an alternate arrangement of panel assemblies in the side and roof of an enclosure.
Figure 7:
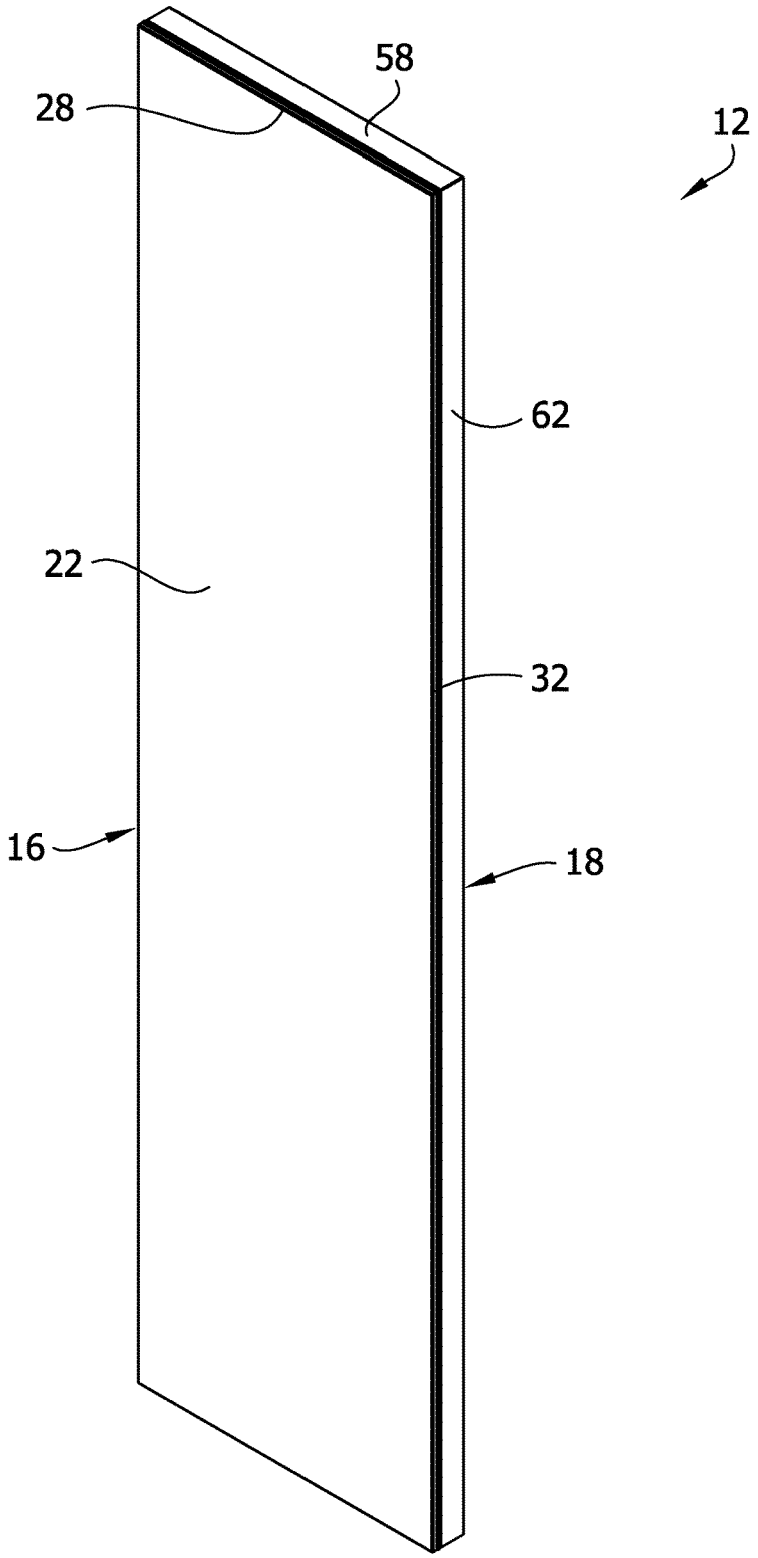
FIG. 7 is a front perspective of a panel assembly.
Figure 7A:
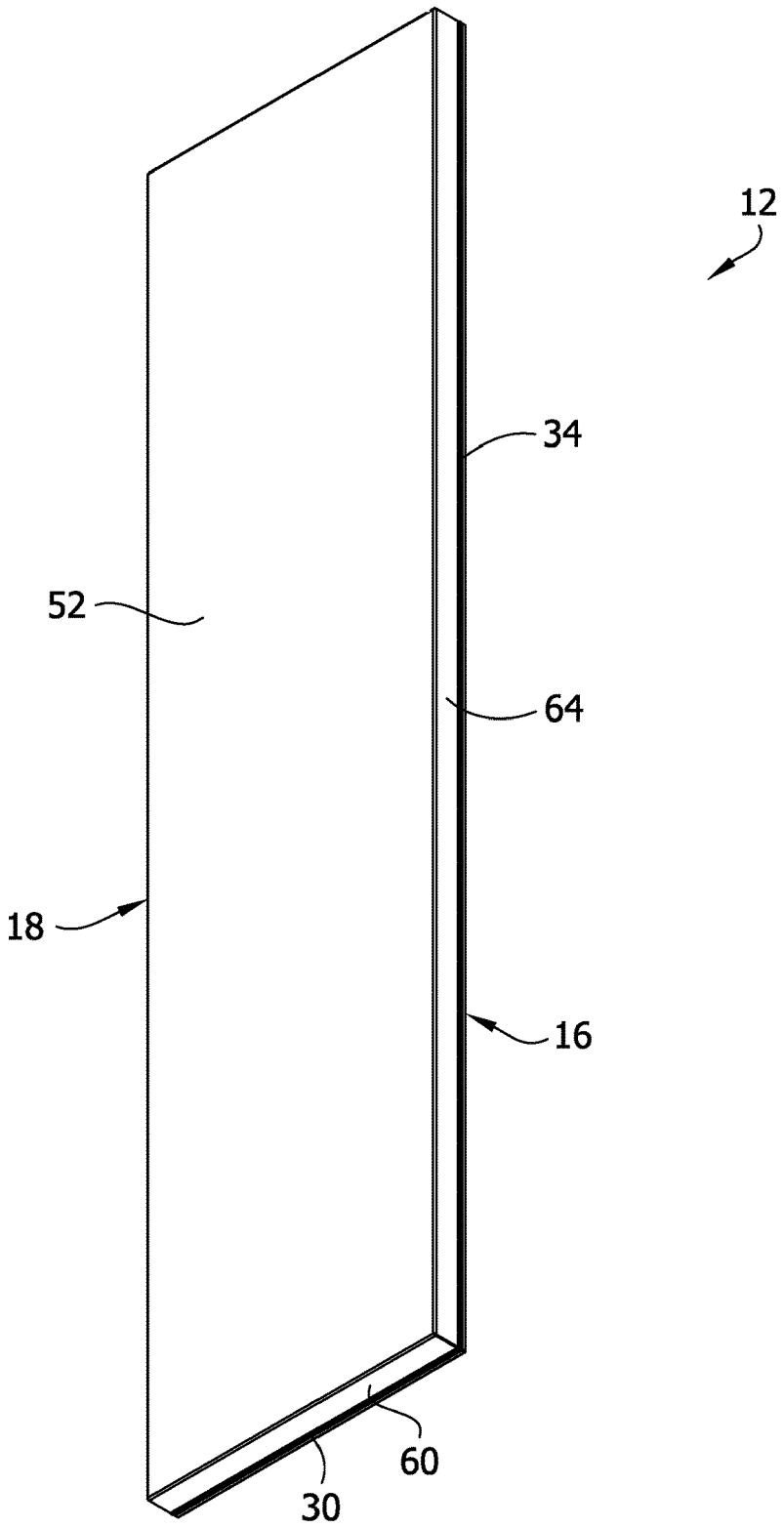
FIG. 7A is a rear perspective of a panel assembly.

Any number of panel assemblies 12 may be connected together in the same fashion to produce a side wall of a desired length for an enclosure. In the illustrated embodiment, the fourth panel assembly 12 is connected to panel assemblies forming another corner of the enclosure 10, for example the lower left hand corner as shown in FIG. 2. Each corner may be formed of two panel assemblies 12 at right angles to each other, in the same way as described above for the first and second corner panel assemblies. After or prior to completion of all side walls of the enclosure 10, a roof may be assembled and attached to the side walls. Referring now to FIGS. 6 and 6A, the roof may be assembled from panel assemblies 12 of the same construction or a different construction. As shown in FIGS. 1 and 6 panel assemblies 12' that are shorter in length than the panel assemblies 12. The panel assemblies 12' are otherwise of the same construction as the panel assemblies 12. Corresponding parts of the panel assemblies 12' will be given the same reference numerals with the addition of a prime.

The panel assemblies 12' can be laid on top of the side walls formed by panel assemblies 12. Adjacent panel assemblies 12' can be connected to each other using a thermally insulating slat (not shown), but having the same construction as the thermally insulating slat 80, only shorter in length. Connection of the roof to the panel assemblies 12 of the side walls can be made using an interior angle 142 and an exterior bracket 144 which are substantially the same as the angle 102 and bracket 104 used to make the corner connection between the first and second panel assemblies 12. Gaskets 113 are placed between the bracket 144 and the panel assemblies 12, 12'. A flashing 146 substantially identical to flashing 106 can be placed over the exterior bracket 144 when the connection is complete. Thus, the same components can be used to make the roof connection as were used to make the corner connections. FIG. 6A illustrates the roof connection when each of the panel assemblies 12' is inverted from the configuration shown in FIG. 6.

By using the thermally insulating slats 80 to connect the panel assemblies 12, screws are not required to attach the internal side panel assemblies 12 together. This provides a smooth outer surface for the enclosure 10 which facilitates cleaning of the enclosure. A smooth outer surface may also provide an aesthetic benefit to the enclosure 10. In addition to applications for HVAC equipment, the enclosure 10 can also be used in other applications such as large walk-in coolers and freezers, in part because of the connection between the panel assemblies 12.

Figure 16:
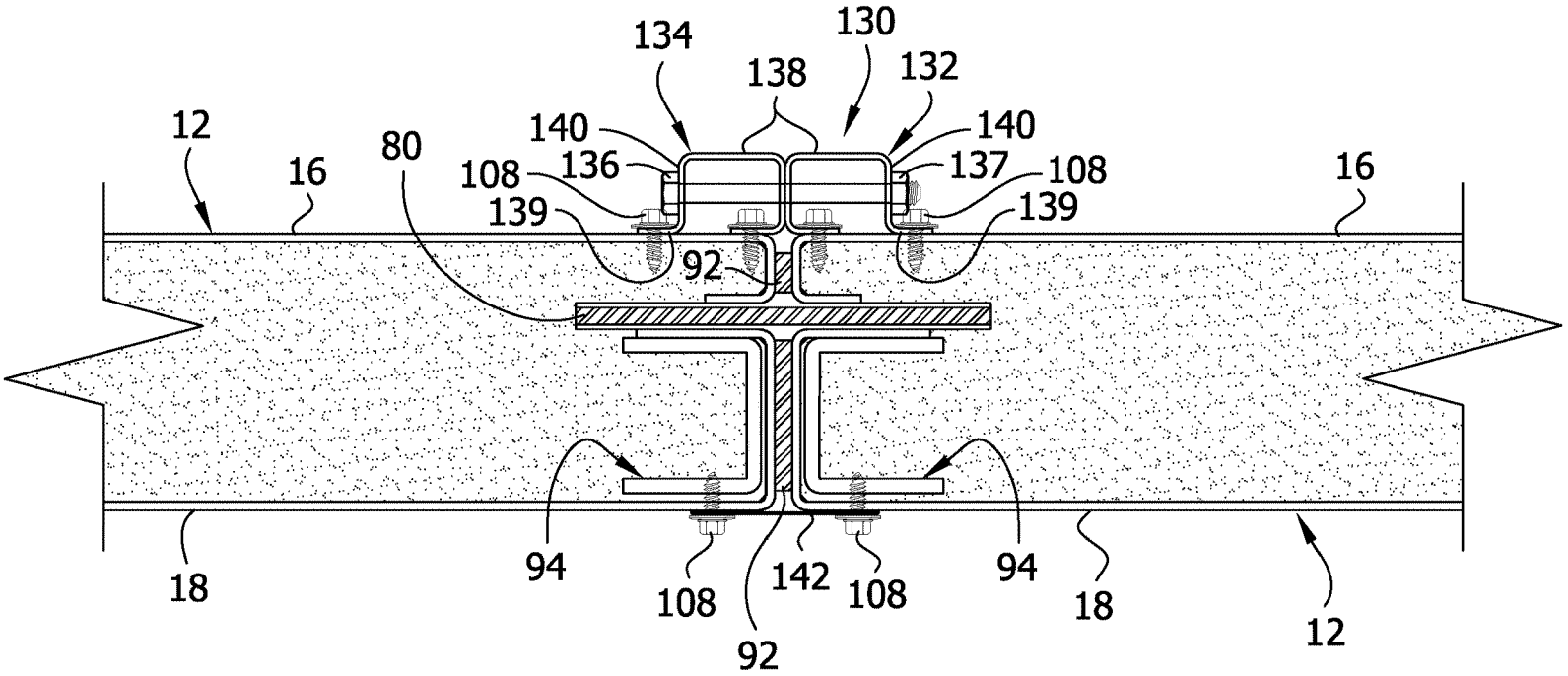
FIG. 16 is an illustration of a connection between adjacent panel assemblies.
Figure 16A:
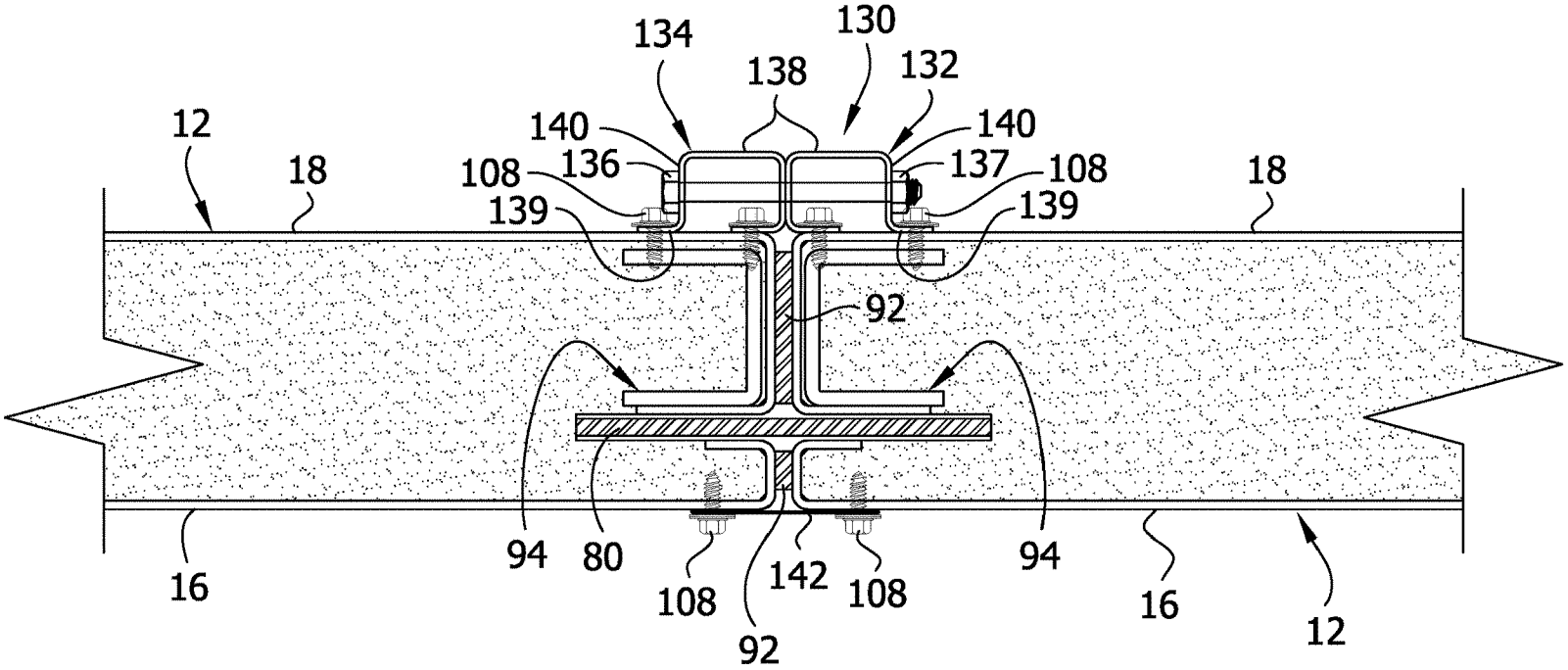
FIG. 16A is an illustration of a connection between adjacent panel assemblies having an alternative arrangement.

In some instances, the air pressure differential between the interior and exterior of the enclosure 10 will require additional reinforcement and interconnection between the adjacent panel assemblies 12, 12'. Referring to FIGS. 16 and 16A, a reinforced connection between adjacent side wall panel assemblies 12 is shown. In this embodiment, a bracket assembly 130 secures the panel assemblies 12 together. The bracket assembly 130 comprises a first bracket 132 attached to the third panel assembly 12 by screws 108, a second bracket 134 attached to the adjacent fourth panel assembly 12 by screws 108, and a tie bolt 136 and nut 137 configured to secure the brackets together thereby securing the panel assemblies 12 together. Each bracket 132, 134 comprises a channel shaped member including a base 138 and opposing sides 140 extending from ends of the base. Flanges 139 extend from the opposing sides 140 and are generally parallel to the base 138. Each flange 139 on a bracket 132, 134 extends in the same direction. In the arrangement shown in FIG. 16, screws 108 extend through the flanges 139 to attach the brackets 132, 134 to the front portions 22 of the first panel members 16 of the panel assemblies 12. An elongate tie sheet 142 extends along a junction between the panel assemblies 12 at the second panel members 18. Screws 108 attach the tie sheet 142 to the front portions 52 of the second panel members 18 of the panel assemblies 12. The screws 108 further pass into respective ones of the stiffeners 94.

In the arrangement shown in FIG. 16A, the panel assemblies 12 are inverted so screws 108 extend through the flanges 139 to attach the brackets 132, 134 to the front portions 52 of the second panel members 18 of the panel assemblies 12. In the configuration of FIG. 16A, the screws 108 attaching the brackets 132, 134 pass into and connect with the stiffeners 94. The tie sheet 142 extends along a junction between the panel assemblies 12 at the first panel members 16. Screws 108 attach the tie sheet 142 to the front portions 22 of the first panel members 16 of the panel assemblies 12. The brackets 132 and 134 may be attached to the panel assemblies 12 at the factory. The tie bolt 136 and nut 137 can be applied in the field to connect the brackets 132, 134 together. During installation of the enclosure 10 in the field, the tie bolt 136 and nut 137 can be tightened to fully secure the panel assemblies together.

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. An insulated panel assembly for use in forming a thermally insulated enclosure, the insulated panel assembly comprising a housing having inner and outer major surfaces and edge surfaces extending between the inner and outer major surfaces, an interior cavity defined by the housing, a injected, monolithic insulating core within the interior cavity of the housing, an elongate slot in at least one of the edge surfaces of the housing extending inward of the edge surface toward the interior cavity, the housing including a first panel member formed of one piece of material having a front portion, first and second side portions extending from the front portion, and first and second side mounting flanges extending from the respective first and second side portions, a second panel member formed of one piece of material having a front portion, first and second side portions extending from the front portion, and first and second side mounting flanges extending from the respective first and second side portions, the slot being located between the first mounting flange of the first panel member and the first mounting flange of the second panel member and comprising an open space, the slot being defined by boundary surfaces exposed to the open space of the slot, at least a portion of the boundary surface defining a closed end of the slot being on the insulating core, the insulating core extending in a direction transverse to a lengthwise extent of the slot from the first side portions of the first and second panel members to the second side portions of the first and second panel members, the insulating core engaging the first mounting flange of the first panel member and engaging the first mounting flange of the second panel member.

2. The insulated panel assembly as set forth in claim 1 further comprising a slat sized and shaped to fit edgewise into the elongate slot with an interference fit in the elongate slot.

3. The insulated panel assembly as set forth in claim 2 wherein the slat is made of a thermoplastic polymer material.

4. The insulated panel assembly as set forth in claim 2 wherein the slat has a length substantially the same as a length of the edge surface including the slot.

5. The insulated panel assembly as set forth in claim 1 wherein the slot extends from the edge surface into the insulating core.

6. The insulated panel assembly as set forth in claim 1 wherein the edge surface has a length, the slot extending the full length of the edge surface.

7. The insulated panel assembly as set forth in claim 1 wherein the edge surface including the slot constitutes a first edge surface, the insulated panel assembly further comprising an elongate slot in a second of the edge surfaces of the housing.

8. The insulated panel assembly as set forth in claim 7 wherein a third of the edge surfaces has a thermally insulating gasket therein.

9. The insulated panel assembly as set forth in claim 1 wherein the first panel member further comprises top and bottom portions extending from the front portion of the first panel member, and mounting flanges extending from the respective top and bottom portions, and wherein the second panel member further comprises top and bottom portions extending from the front portion of the second panel member, and first and second mounting flanges extending from the respective top and bottom portions, a gasket being located between the mounting flanges of the top and bottom portions of the first panel member and between the mounting flanges of the top and bottom portions of the second panel member.

10. The insulated panel assembly as set forth in claim 1 further comprising a stiffener located in the housing adjacent to the edge surface including the slot.

11. The insulated panel assembly as set forth in claim 1 wherein the housing has an exterior surface including the inner and outer surfaces and the edge surfaces of the housing, the exterior surface defining a rectangular parallelepiped.

12. The insulated panel assembly as set forth in claim 11 wherein the exterior surface of the housing is free of outwardly projecting structure.

13. The insulated panel assembly as set forth in claim 1 wherein the first and second panel members each define at least a portion of one of the boundary surfaces exposed to the open space of the slot.

14. A method of assembling an insulated panel assembly for use in forming a thermally insulated enclosure, the method comprising:

locating a first panel member relative to a second panel member such that the first panel member opposes the second panel member and is spaced apart from the first panel member;

positioning insulation between the first and second panel members, the located first panel member and second panel member defining a housing having inner and outer major surfaces and edge surfaces extending between the inner and outer major surfaces and an interior cavity in which the insulation is positioned;

providing a slot in the housing extending inward from at least one of the edge surfaces of the housing toward the interior cavity wherein providing the slot in the housing comprises cutting away a spacer between the first and second panel members along said one edge surface of the housing.

15. The method as set forth in claim 14 further comprising providing another slot in the housing by cutting away the spacer between the first and second panel members along another of the edge surfaces of the housing.

16. The method as set forth in claim 14 further comprising providing a slat sized for an interference fit in the slot of the housing and to project laterally outward from said one edge surface of the housing when fully seated in the slot.

17. A method of assembling a thermally insulated enclosure comprising:

providing a first thermally insulated panel assembly having inner and outer major surfaces and edge surfaces extending between the inner and outer major surfaces and an interior cavity in which insulation is disposed;

inserting a slat into a slot in one of the edge surfaces of the panel assembly, the slot having an open mouth at the edge surface of the panel assembly and an opposite closed end in the interior cavity of the panel assembly, the slot extending along the majority of a length of the edge surface, the slot defining a volume extending between the open mouth and the closed end, the volume being sized and shaped to receive the slat and being everywhere free of obstruction;

providing a second thermally insulated panel assembly having inner and outer major surfaces and edge surfaces extending between the inner and outer major surfaces and an interior cavity in which insulation is disposed next to the first panel assembly so that the slat is received in a slot in one of the edge surfaces of the second thermally insulated panel assembly thereby connecting the first and second panel assemblies together.

18. The method of claim 17 wherein the slat is inserted into the slot of the first panel assembly before it is inserted into the slot of the second panel assembly.

19. The method of claim 17 wherein the first and second panel assemblies are arranged with a third and other panel assemblies to form the thermally insulated enclosure, the enclosure having an exterior surface defined by the panel assemblies, at least a majority of the exterior surface defined by the first and second panel assemblies between upper and lower ends of the enclosure being free of fasteners connecting the first panel assembly to the second panel assembly.

20. The method of claim 17 wherein the slot extends along the full length of the edge surface of the panel assembly.

* * * * *